US010548391B2

(12) United States Patent
Satterfield

(10) Patent No.: US 10,548,391 B2
(45) **Date of Patent: *Feb. 4, 2020**

(54) TOOL POUCH WITH BI-STABLE HINGED CLOSURES

(71) Applicant: Rogue Innovative Tools, Inc.

(72) Inventor: Joseph Allen Satterfield, Medford, OR (US)

(73) Assignee: ROGUE INNOVATIVE TOOLS, INC., Medford, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/221,432

(22) Filed: Dec. 14, 2018

(65) Prior Publication Data

US 2019/0133307 A1 May 9, 2019

Related U.S. Application Data

(63) Continuation-in-part of application No. 16/101,267, filed on Aug. 10, 2018, now abandoned, which is a (Continued)

(51) Int. Cl.

| | |
|---|---|
| ***A45F 3/00*** | (2006.01) |
| ***A45F 5/02*** | (2006.01) |
| ***B25H 3/00*** | (2006.01) |

(52) U.S. Cl.

CPC ..... *A45F 5/021* (2013.01); *A45F 3/005* (2013.01); *B25H 3/00* (2013.01); *A45F 2200/0575* (2013.01)

(58) Field of Classification Search

CPC ... Y10S 224/904; Y10S 150/90; B65D 33/02; B65D 33/30; Y10T 16/540295; A45C 13/04; A45C 13/06; A45F 5/00; A45F 5/02; A45F 3/005; A45F 5/022; A45F 5/021; A45F 2200/0575; E05D 11/10; E05D 11/1007; E05D 11/1014; E05D 11/1028; E05D 11/105; E05D 11/1064; (Continued)

(56) References Cited

U.S. PATENT DOCUMENTS 1,741,603 A * 12/1929 Axelman ..... A45C 13/04 190/121

1,925,487 A 9/1933 Karron (Continued)

FOREIGN PATENT DOCUMENTS

WO 8803461 A1 5/1988

*Primary Examiner* — Adam J Waggenspack

(74) *Attorney, Agent, or Firm* — Scheinberg & Associates, PC; Michael O. Scheinberg; John B. Kelly

(57) ABSTRACT

A tool pouch, tool bag, utility pouch, or similar, comprising one or more individual tool pouches, used by tradesmen in difficult and/or dangerous environments where it would be convenient and preferred for safety reasons for the tool pouches to remain closed or remain open without manual intervention. Tool pouches within a tool pouch are configured with bi-stable hinges in which an over-center cam-spring arrangement alternatively maintains either a fully-closed or a fully-open configuration until an intentional opening or closing action by a user. Individual tool pouches within a tool pouch may be opened or closed independently of the open or closed positions of other tool pouches.

25 Claims, 37 Drawing Sheets

Related U.S. Application Data continuation of application No. 15/178,183, filed on Jun. 9, 2016, now Pat. No. 10,051,949, which is a continuation-in-part of application No. 14/450,619, filed on Aug. 4, 2014, now Pat. No. 9,427,067.

(60) Provisional application No. 61/985,857, filed on Apr. 29, 2014.

(58) Field of Classification Search

CPC ..... E05D 11/1071; E05D 11/1078; E05D 11/1085; E05D 5/006; E05D 2011/1035; E05D 11/08; E05D 11/081; E05D 11/082; E05D 11/084; E05D 2011/085; E05D 11/087; E05D 11/1042; E05D 2005/145; E05D 5/10; E05D 5/14; E05D 5/16

USPC ..... 224/660; 16/319, 321, 334, 335, 336, 16/337, 341, 342; 248/99; 150/120, 150/125–126; 383/33–34, 79, 92

See application file for complete search history.

(56) References Cited

U.S. PATENT DOCUMENTS

| | | | | | |
|---|---|---|---|---|---|
| 2,040,271 | A | | 5/1936 | Rosenzweig | |
| 2,064,568 | A | * | 12/1936 | Sachs | A45C 13/04 150/104 |
| 2,142,904 | A | * | 1/1939 | Lamarthe | A45C 13/06 24/30.5 R |
| 3,145,748 | A | * | 8/1964 | Leonardi | A45C 13/04 150/123 |
| D254,759 | S | | 4/1980 | Rodstein | |
| 4,368,767 | A | * | 1/1983 | Friedman | A45C 13/04 150/104 |
| 5,067,643 | A | | 11/1991 | McKinney | |
| D344,630 | S | | 3/1994 | Doerksen | |
| 5,509,515 | A | * | 4/1996 | Guo | A45C 7/0086 150/111 |
| 5,609,419 | A | * | 3/1997 | Byers, Jr. | A45C 13/06 224/674 |
| 5,639,003 | A | | 6/1997 | Utzinger | |
| 5,649,623 | A | | 7/1997 | Kornblatt | |
| 5,680,026 | A | | 10/1997 | Lueschen | |
| 5,743,451 | A | | 4/1998 | Kahn | |
| 5,813,530 | A | | 9/1998 | Kornblatt | |
| 5,988,315 | A | | 11/1999 | Crane | |
| 6,390,348 | B1 | * | 5/2002 | Godshaw | A45F 5/00 224/660 |
| 6,435,389 | B1 | | 8/2002 | Sucher | |
| D482,524 | S | | 11/2003 | Cabrera et al. | |
| 6,701,534 | B2 | | 3/2004 | Guibord | |
| 6,726,075 | B1 | * | 4/2004 | Patel | A45F 3/14 224/582 |
| 6,848,605 | B2 | | 2/2005 | Dillenberger | |
| 7,011,241 | B2 | | 3/2006 | Godshaw et al. | |
| 8,028,872 | B2 | | 10/2011 | Hamlin | |
| D658,852 | S | | 5/2012 | McCoy | |
| 8,220,683 | B2 | | 7/2012 | Williams | |
| 8,919,629 | B2 | | 12/2014 | Moreau et al. | |
| 8,991,672 | B2 | | 3/2015 | Hassler | |
| 9,427,067 | B2 | | 8/2016 | Satterfield | |
| 2004/0178240 | A1 | | 9/2004 | Bauer | |
| 2006/0102674 | A1 | | 5/2006 | Godshaw et al. | |
| 2007/0006367 | A1 | | 1/2007 | Newman et al. | |
| 2008/0023515 | A1 | | 1/2008 | Coonan et al. | |
| 2008/0185414 | A1 | | 8/2008 | Conlon | |
| 2009/0145789 | A1 | | 6/2009 | Panosian et al. | |
| 2012/0138623 | A1 | | 6/2012 | Verma | |
| 2013/0008933 | A1 | | 1/2013 | Clifford | |
| 2014/0161371 | A1 | | 6/2014 | Moreau et al. | |
| 2014/0353352 | A1 | | 12/2014 | Shapiro | |
| 2016/0029774 | A1 | | 2/2016 | Satterfield | |

* cited by examiner

FIG. 18
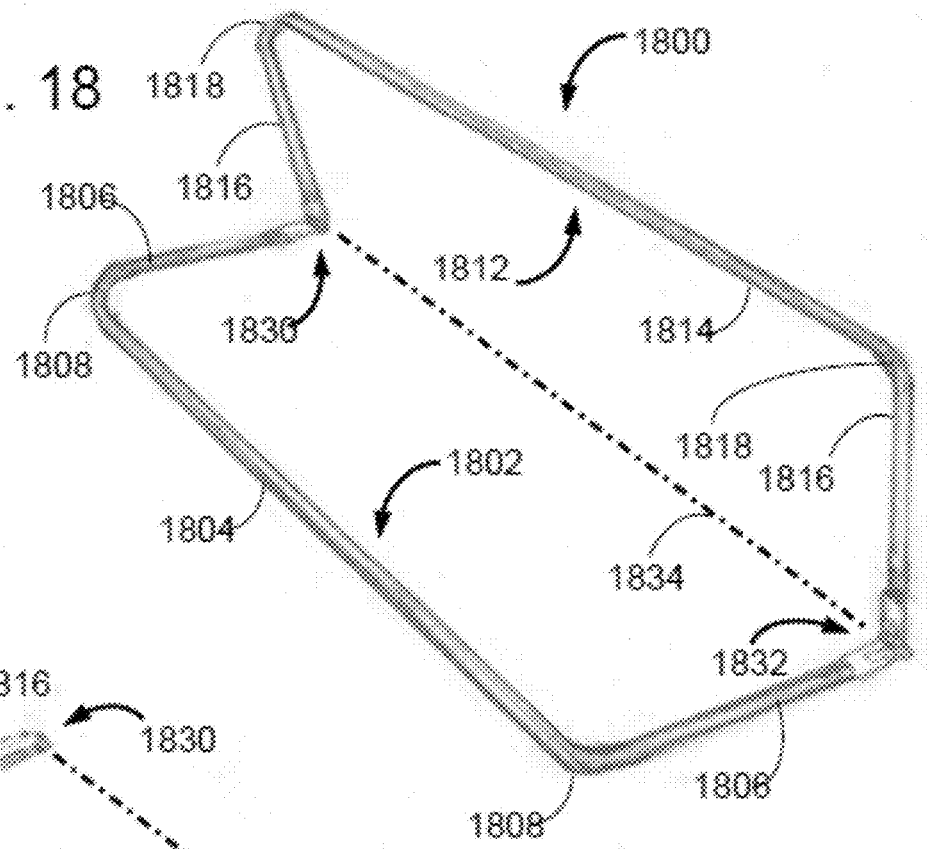
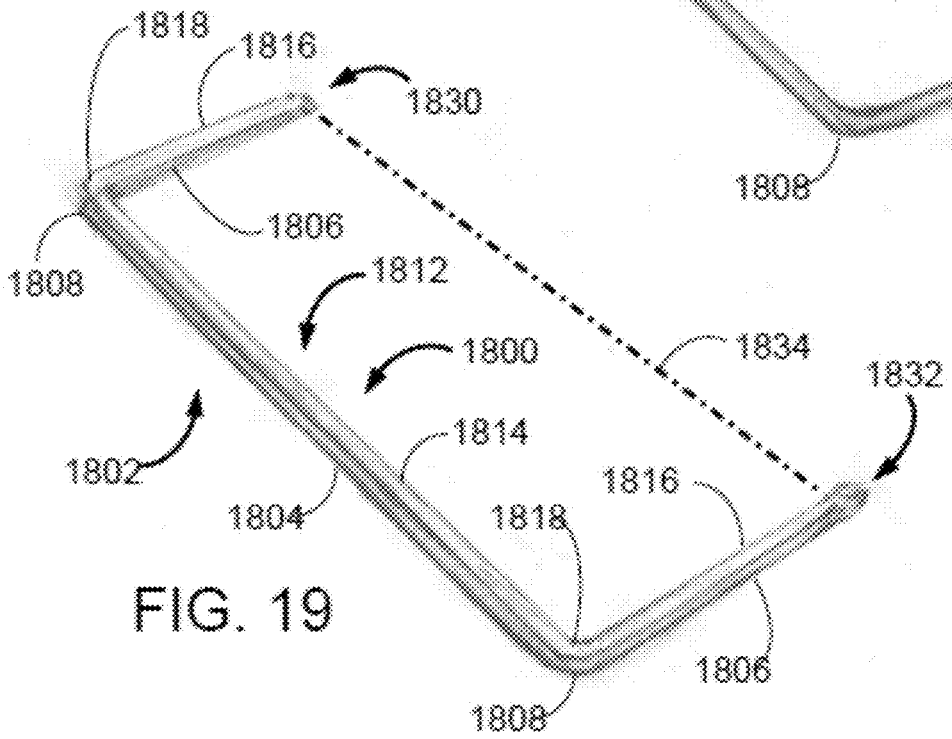
FIG. 19

TOOL POUCH WITH BI-STABLE HINGED CLOSURES

CROSS-REFERENCE TO RELATED APPLICATIONS

This is a continuation-in-part of U.S. patent application Ser. No. 16/101,267, filed Aug. 10, 2018, which is a continuation of U.S. patent application Ser. No. 15/178,183, filed Jun. 9, 2016 and issued on Aug. 21, 2018 as U.S. Pat. No. 10,051,949, which is a continuation-in-part of U.S. patent application Ser. No. 14/450,619 filed Aug. 4, 2014, issued on Aug. 30, 2016 as U.S. Pat. No. 9,427,067 B2, which claims the benefit of U.S. Patent Application 61/985,857 filed Apr. 29, 2014.

TECHNICAL FIELD

The present invention relates to tool pouches, tool bags, utility pouches, etc., and in particular to pouches having a stable open position and a stable closed position.

BACKGROUND

As used herein, a "pouch" mean a flexible receptacle in which portions of the flexible receptacle come together to close the receptacle and the portions of the flexible receptacle spread apart to allow objects to enter and leave the receptacle. Examples include tool pouches, which are commonly used by tradesmen to carry items such as tools, parts, and supplies while working. Tool pouches are often carried by handles or connected to a belt worn by tradesmen to provide access to items while working. A tool pouch should provide easy access to the stored items when access is required and should secure items stored in the pouch when the items are not needed. Preferably, when closed, the tool pouch will contain the objects therein regardless of the orientation of the pouch in space, that it, whether the pouch is right side up, upside down, or lying sideways.

A tool belt may support one or more tool pouches to organize and provide easy access to a variety of items. Each of the tool pouches can preferably be opened and closed independently from the other pouches. For strength and longer-lifetimes, pouches are typically fabricated from flexible, durable, puncture- and tear-resistant materials such as leather, canvas, or nylon. Pouches may be supported by a frame that is more rigid than the flexible material of which the pouch is composed. The frame may be composed of metal, plastic, or other materials Various tool pouches are described, for example, in U.S. Pat. No. 6,390,348 to Godshaw, et al. for a "Tool Belt;" U.S. Pat. No. 6,126,003A to Brouard for a "Tool Bag;" U.S. Pat. No. D316,485 to Seber for a "Combined nail and tool bag;" U.S. Pat. No. D254,759 to Rodstein for a "Tool Pouch;" U.S. Pat. No D648532S1 to Sosnovsky for a "Closed Tool Bag;", U.S. Pat. No. 5,067,643 to McKinney for a "Hip level pack frame;" and U.S. Pat. No. D48,2524 to Cabrera et al. for a "Tool Pouch."

U.S. Pat. No. 9,427,067 for a "Tool Belt" and U.S. Pat. Pub. 2017/0095069 for a "Tool Pouch with Spring Hinged Closure," both from the present applicant, describe a tool pouch having a closure mechanism that allow the tool pouch to be put into a stable open position or a stable closed position.

SUMMARY

An object of the disclosure is to provide a closure mechanism for a pouch, a pouch using the closure mechanism, a system with one or more pouches, a method of opening and other related system and methods.

A closure mechanism provides a pouch having two stable positions: an open position and a closed position. In some embodiments, the bi-stable spring closure can be formed in part by rods or straps. The closure mechanism is at least partly enclosed in a sleeve. In some embodiments, the sleeve is not formed by folding over the pouch material.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which:

FIG. 18 shows an isometric view of a second embodiment of a tool pouch closure in an open position.

FIG. 19 shows an isometric view of the tool pouch closure of FIG. 18 in a closed position.

DETAILED DESCRIPTION OF EMBODIMENTS

Tool Pouch Closure with Bi-Stable Hinges

Figure 1:
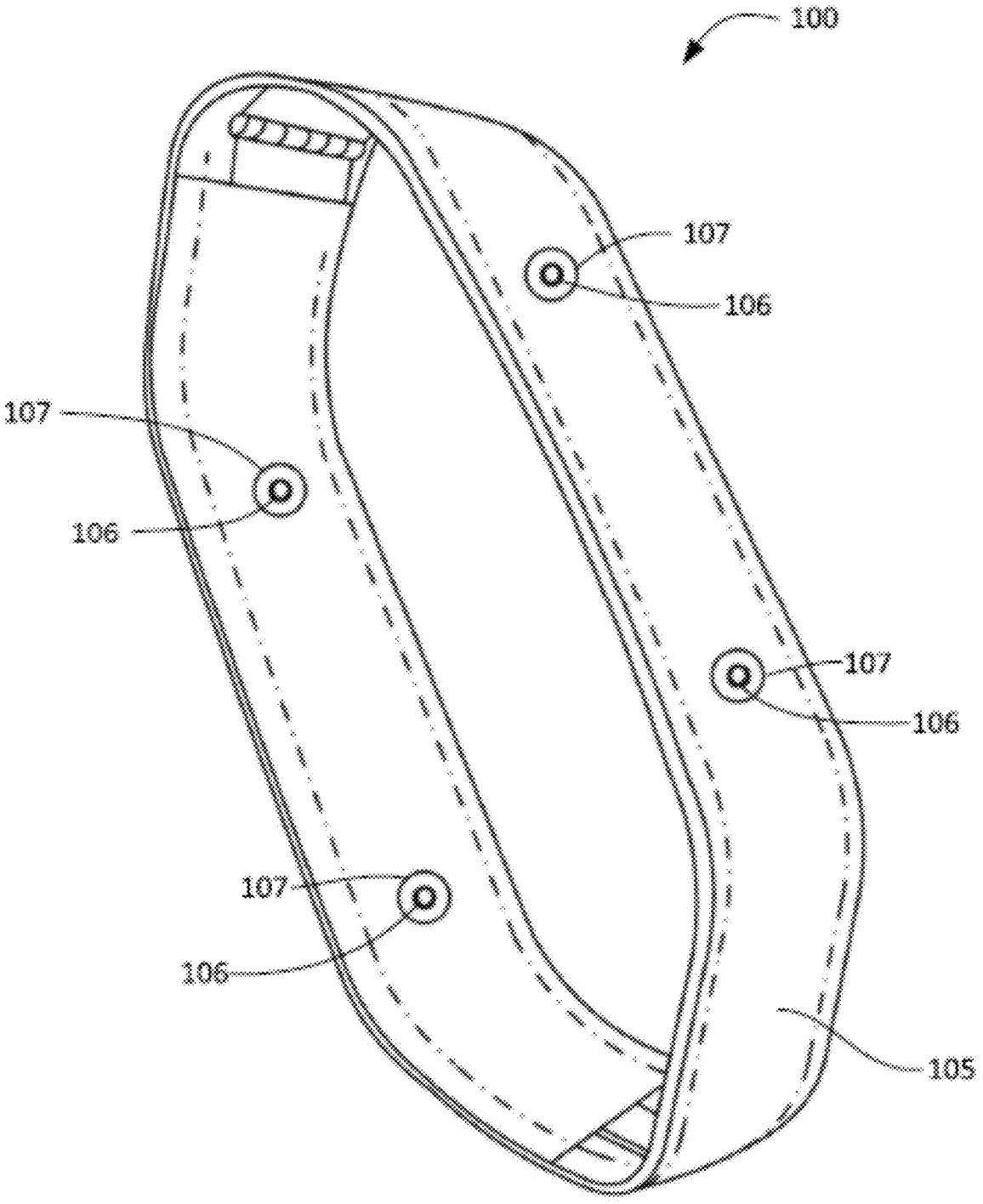
FIG. 1 illustrates a first embodiment of a tool pouch closure in the open position.

Various embodiments of the present invention provide a tool pouch having a bi-stable hinge. That is, the hinge will remain in the open position once opened and the closed position when closed.

First Embodiment

It is desirable for some embodiments of a tool pouch to have a closure device that may be integrated into an existing tool pouch design without altering the pouch shape or materials used to construct the pouch. To achieve such a closure device and associated structure, flexible frame closures may be used. Closures with spring actuated detent hinges attached to flexible spring steel bands or rods are preferably used. This type of closure allows the sides of the pouch to be flexible while open and for the pouch to be flat while in the closed position. If worn on a belt, when the pouch is closed flat it moves the pouch closer to the body. When multiple pouches are attached together, the advantages of flat closing pouches are greatly appreciated especially while being stored in a truck box or being worn in tight work areas. Detent spring hinges (such as over-center or cam hinges), attached to steel bands or rods may be used to form a spring hinged closure.

In some embodiments, the spring hinged closure may be completely sewn into the tool pouch such that no portion of the spring hinge closure is exposed. In other embodiments, a portion or all of the spring hinge closure may be exposed.

In some embodiments the detent spring hinged closure, when opened, shortens in length while the tool pouch does not readily shorten in a similar manner. A pouch measured front to back when closed would use a closure of the same length within that pouch. The closure, when opened, shortens, pulling the hinges inward towards each other as the flexible bands bend and move outward in opposite directions. Typically, the closure is ten to fifteen percent shorter while in the fully opened position than when in the closed position. In those embodiments, the tool pouch, along with any of various holders mounted to the front and rear of the pouch, should be sufficiently flexible to accommodate the closure's movement, including the lengthening and shortening.

Unlike handbags which are supported equally by both sides of the bag allowing both sides of the handbag to move in unison, tool pouches are sometimes supported by one side, affixed to either another larger pouch or directly to a belt worn around the waist. They can project outward six to twelve inches away from the waist and when loaded with tools and fasteners can be heavy. When walking or turning the weighted pouch consistently swings to and fro causing the closure assembly to try to shift within the pouch. When the closure's bands and hinges move out of alignment this may cause the hinges to bind and eventually fail.

Tool pouches are used in harsh work environments and at times get damaged. Replacement of a completely sewn-in closure tends to result in at least partial destruction of the integrity of the tool pouch.

A preferred tool pouch closure is designed to not only keep the contents of the tool pouch secure while closed, but when in the open position have the strength and flexibility to remain open, absorbing most bangs and bumps that occur in a typical construction environment. Tradesman prefer to be able to have the option to keep the pouch open throughout the work day without the pouch closing unintentionally. Moreover, a tradesman prefers to have the ability to readily replace the closure in the event of its failure and appreciate the option to remove the closure entirely until a situation requires the closure to be reinstalled.

Referring to FIG. 1, a tool pouch closure 100 in the open position prior to being installed into a tool pouch is illustrated.

Figure 2:
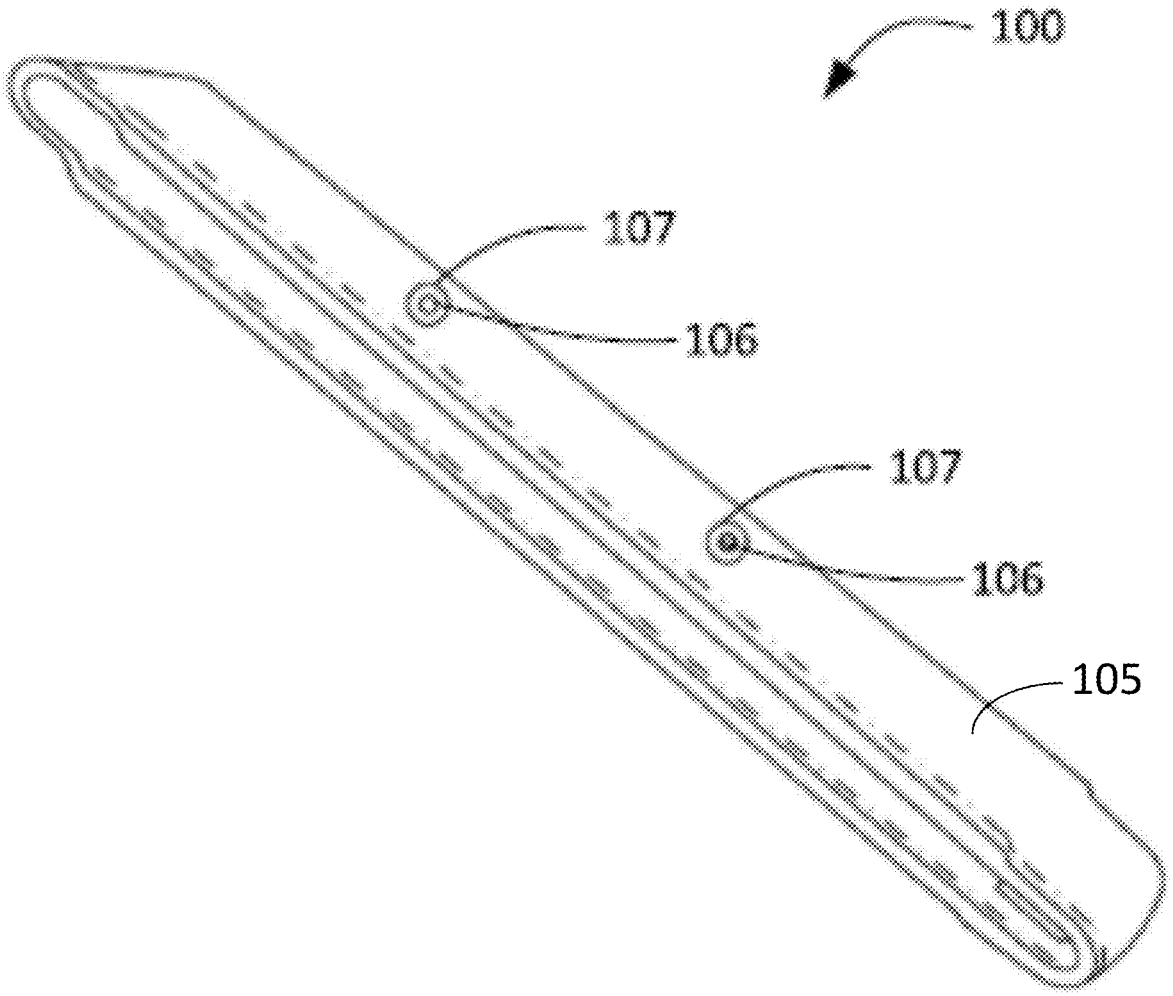
FIG. 2 illustrates the tool pouch closure of FIG. 1 in the closed position.

Referring to FIG. 2, the tool pouch closure 100 in the closed position prior to being installed into a tool pouch is illustrated.

Figure 3A:
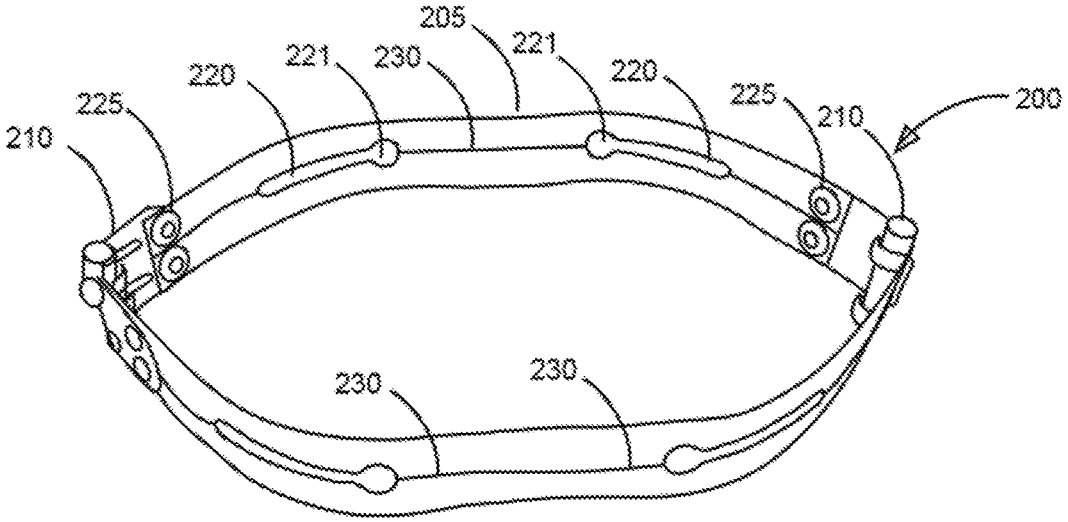
FIGS. 3A and 3B illustrate a first embodiment of a tool pouch closure assembled, without the protective sleeve, in open and closed positions, respectively.
Figure 3B:
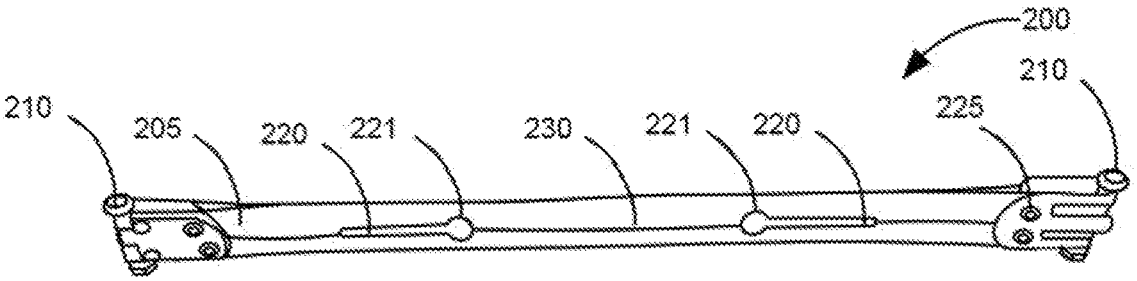

Referring to FIG. 3A and FIG. 3B, the tool pouch closure 100 may include a detent hinged band assembly 200 shown assembled in an open position (see, FIG. 3A) and in closed position (see, FIG. 3B), both without a protective sleeve for illustrative purposes. The closure assembly 200 is comprised of a pair of resilient parallel elongated spring bands 205 attached at their ends to the detent spring actuated hinges 210 by fasteners i.e., rivets 225. The spring steel bands 205 are bent longitudinally into a slight V shape adding a defined crease 230 along the length of the bands (preferably along a major portion of the length). This crease 230 and angular shape in the flexible bands 205 adds structure and dimensional stability and adds memory to the bands which assists the bands to move into a straight, rigid formation when the closure assembly is in the closed position pushing the hinges 210 into a terminal outward position as shown in FIG. 3B. Each band 205 has two opposed keyhole shaped slots 220 positioned approximately one third of the distance in from each hinge 210. The larger circular portion of the keyhole slot 221 allows locations for two eyelets/grommets (one per keyhole) to be installed through both sides of the sleeve/cover and band 205, securing the closure band within the sleeve, thus preventing the closure from shifting within the sleeve. This enlarged, circular openings 221 at the end of slots 220 will be further discussed in FIGS. 7A and 7B and FIG. 8. The balance of the keyhole shaped slot works as a break in the V shaped crease to provide a desired flex location. Reinforcing plates (not shown) may be added between keyholes and at the hinge band connections.

Figure 4A:
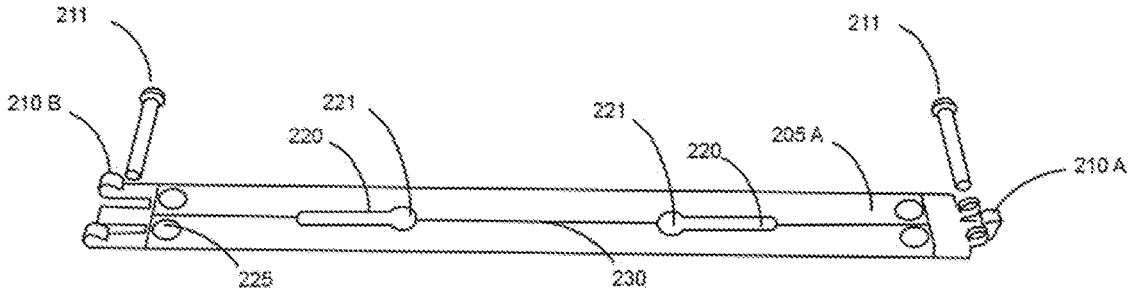
FIGS. 4A and 4B illustrate a pair of opposed detent hinged bands with keyhole slots fastened to the detent hinges prior to assembly.
Figure 4B:
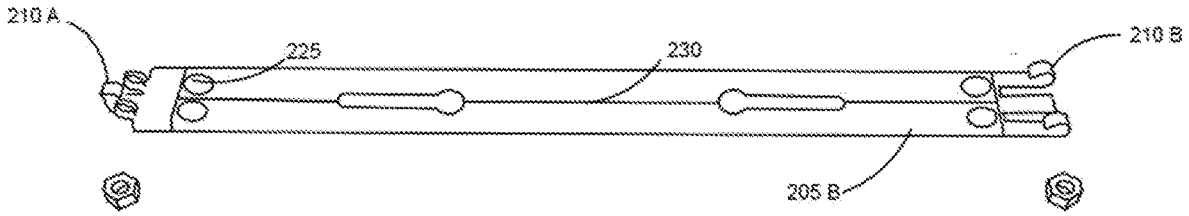

Referring to FIGS. 4A and 4B, a pair of opposed detent hinged bands 205A and 205B without the hinge pins (screws) 211 installed is illustrated. Each side of the assembly is comprised of one V-shaped band with keyhole slots 220 fastened to the two detent hinge components 210A on one end and 210B on the opposite end. Each completed side is identical but are shown oriented in opposing directions. When assembled, hinge 210A from one completed side 205A will join in a hinged relationship with hinge 210B from the other completed side 205B with pivot pins 211 (screws).

Figure 5:
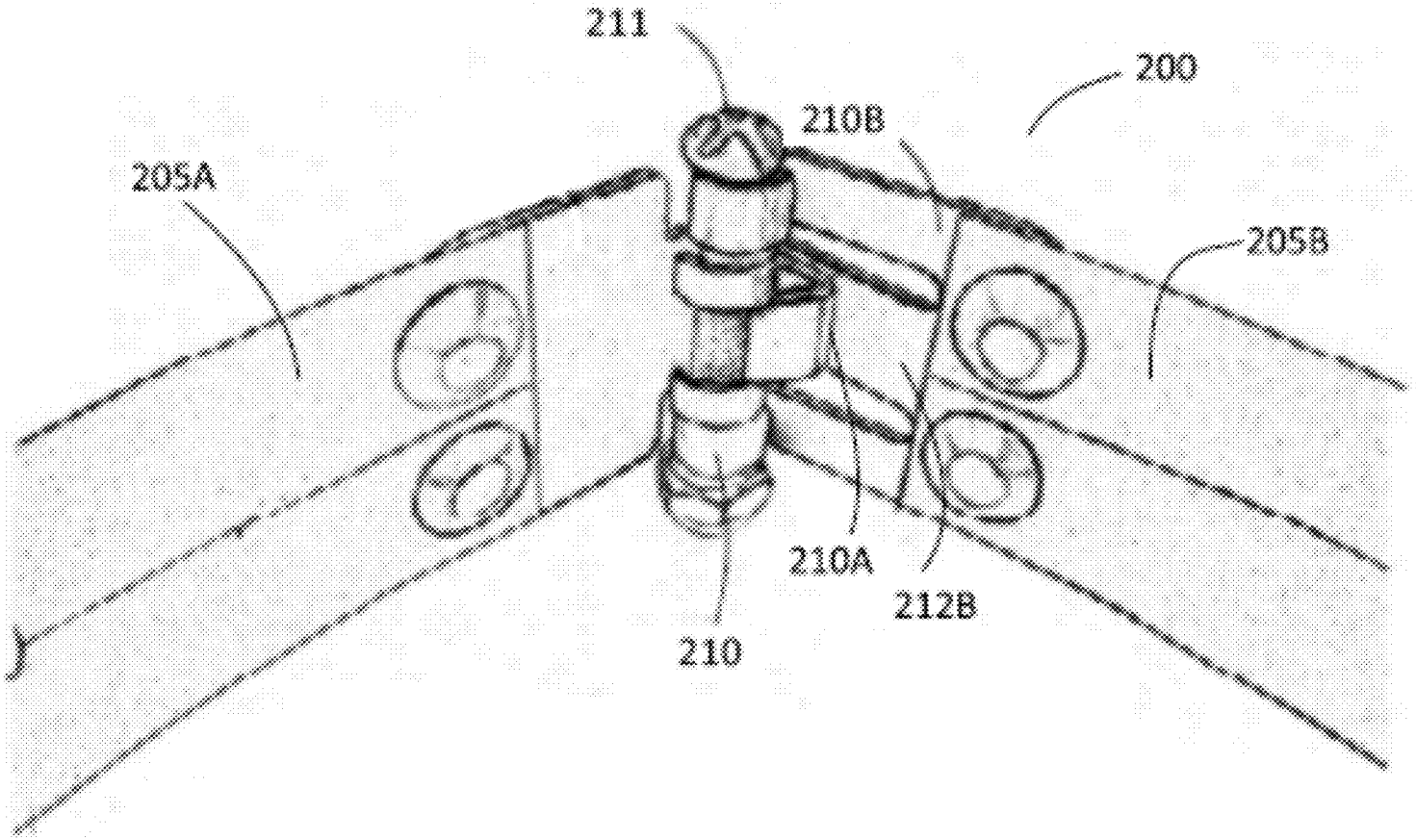
FIG. 5 shows a close-up view of a detent hinge as in FIG. 3A-3B.
Figures 6A, 6B, 6C:
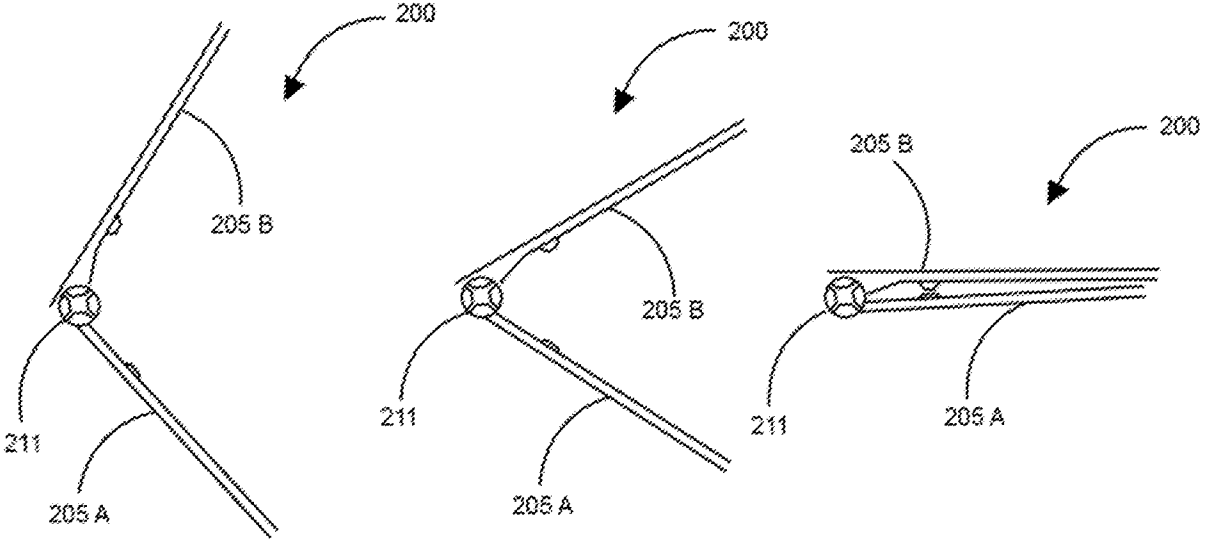
FIGS. 6A-6C illustrate close-up views of an assembled detent hinge in an open position, partially closed/open position, and close position, respectively.

Referring to FIGS. 5-6, the hinge is composed of two sides 210A and 210B joined in a hinged relationship by cooperatively oriented eyelets for receiving a pivot pin or screw 211. One side of the hinge 210A is provided with an aggressive knuckle or detent cam 210A. The matching side leaf hinge 210B is provided with a resilient tang (leaf spring) 212B that is cooperative with the detent cam 210A. Opening the hinge from the closed position (see FIG. 6C) uses the 210B leaf side's tang (leaf spring) 212B to flex up over the angular cam 210A or knuckle on 205A (see FIG. 6B) and rests on a flat detent relaxing the tang 212B, thus holding the hinge in an open position (see FIG. 6A). To close, the leaf tang 212B again flexes up and over the cam 210A (see FIG. 6B) before relaxing into the closed position (see FIG. 6C). Other configurations of the spring hinge, detent spring hinge, and/or flexible band may be used, as desired.

Figure 7A:
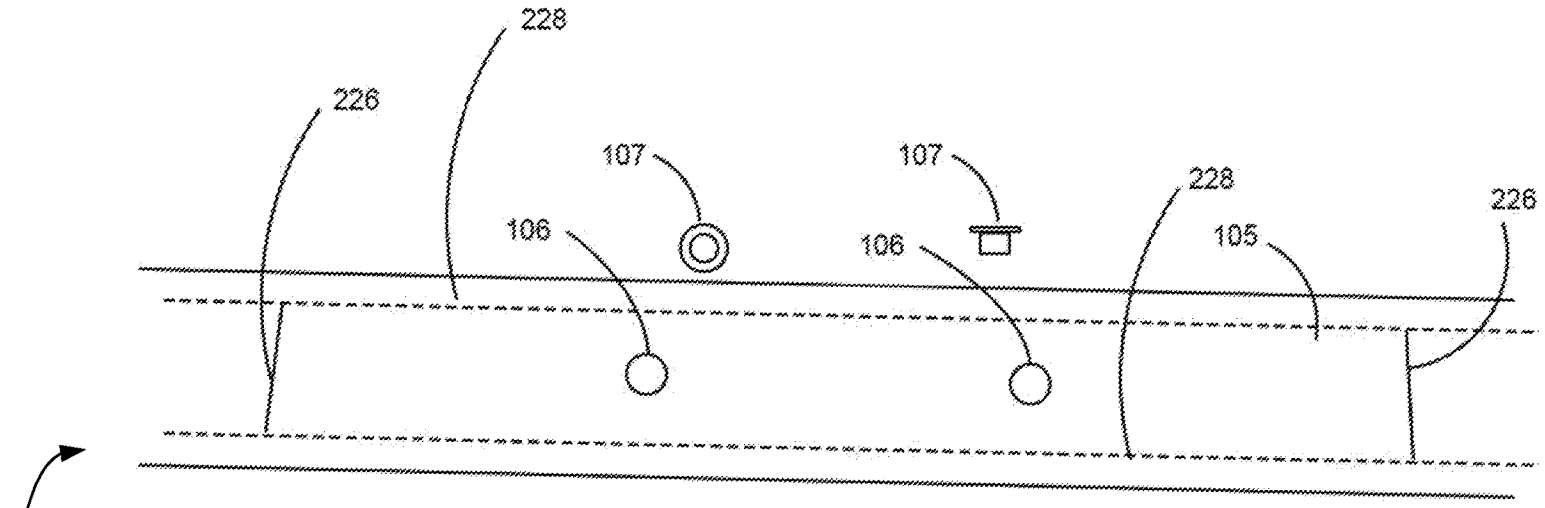
FIGS. 7A and 7B illustrate one side of the tool pouch closure prior to inserting into a protective sleeve.
Figure 7B:
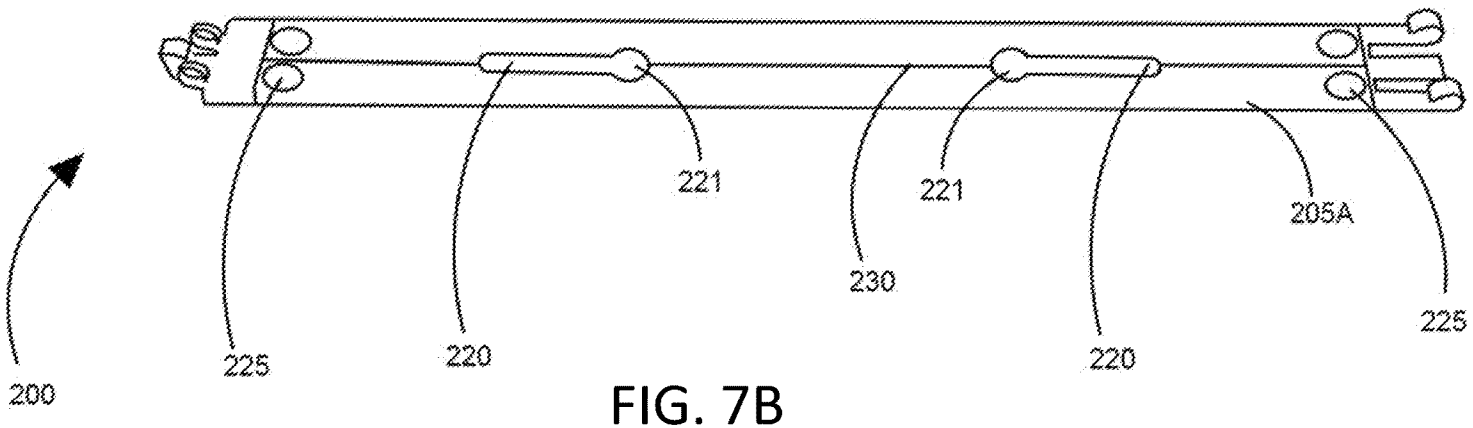

FIGS. 7A and 7B illustrate one half of the length of the protective sleeve/cover 105 sewn 228 together. The sleeve is comprised of an inside piece and an outside piece of wear-resistant material such as leather or ballistic nylon, stitched together so as to leave a longitudinal pocket the length of the sleeve to insert the detent hinged band assembly. There are two breaks 226 on the interior side of the sleeve at the hinge locations to allow access to the hinges. The sleeve 105 is stitched and ready to receive one detent hinged band i.e. 205A or 205B. Each half of the sleeve has two holes 106 punched completely through the inner and outer layers of the sleeve 105. These two holes match up to the enlarged keyhole sections 221.

Figure 8:
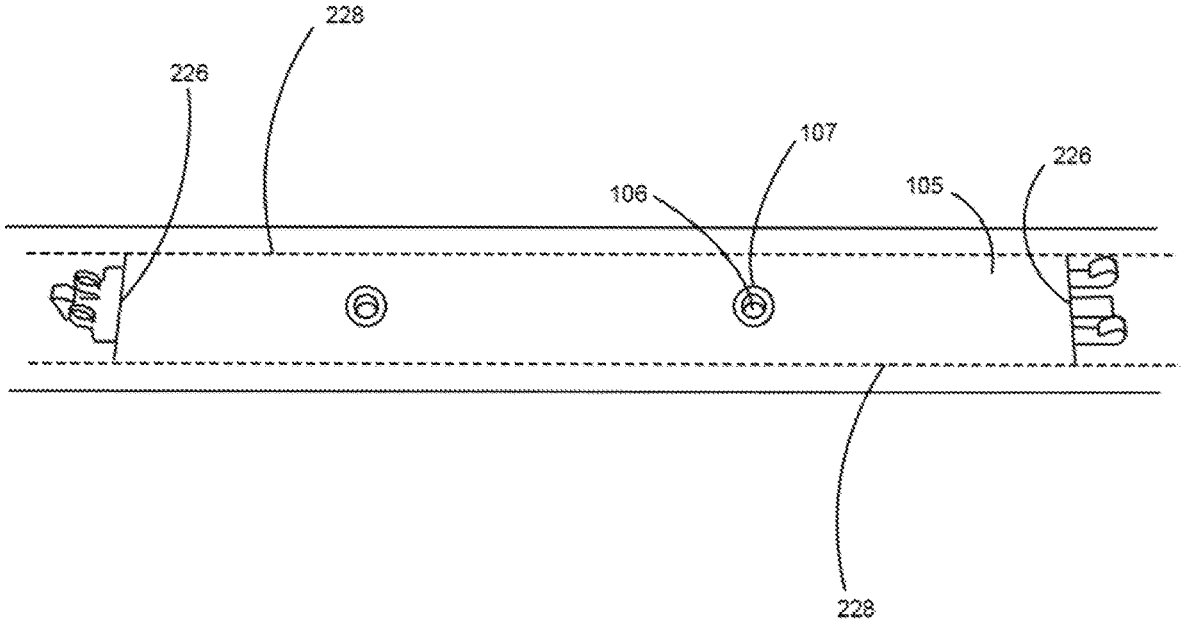
FIG. 8 illustrates one side of the tool pouch closure fastened into the protective sleeve.

Referring to FIG. 8 the hinged band inserted into the sleeve 105 and fastened to the sleeve 105 with two eyelets or grommets 107 is illustrated. The eyelets are inserted through the holes 106 inside of the sleeve proceeding through keyholes 221 and continuing through the outside holes of the sleeve 106 thereby securing the band within the sleeve. This method of fastening the hinged band within the sleeve prevents the detent hinged band assembly from shifting out of alignment within the sleeve 105. Other techniques may likewise be used, as desired.

Figure 9:
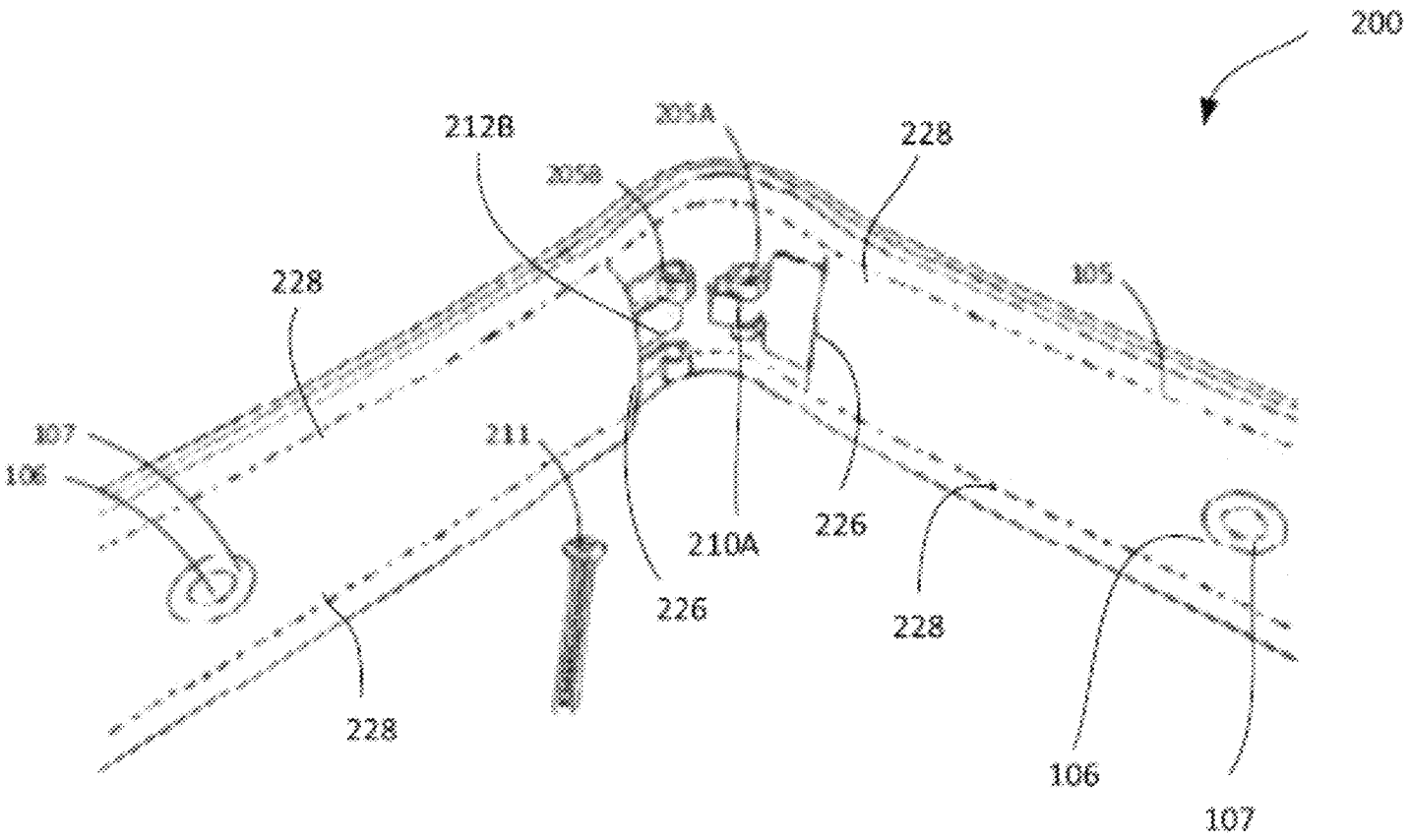
FIG. 9 illustrates the tool pouch closure in the protective sleeve prior to hinge pin insertion.

Referring to FIG. 9, the tool pouch closure's sleeve 105 with both hinged bands 205A and 205B inserted and fastened ready to receive the hinge's pivot pin or screw 211 is illustrated. The screw 211 is shown as it is readily installed and removed although a conventional hinge pin may be used. With the detent hinged bands inserted and fastened within the sleeve/cover and both of the hinge pins installed, the tool pouch closure is ready to be installed (see FIG. 1).

Figure 10:
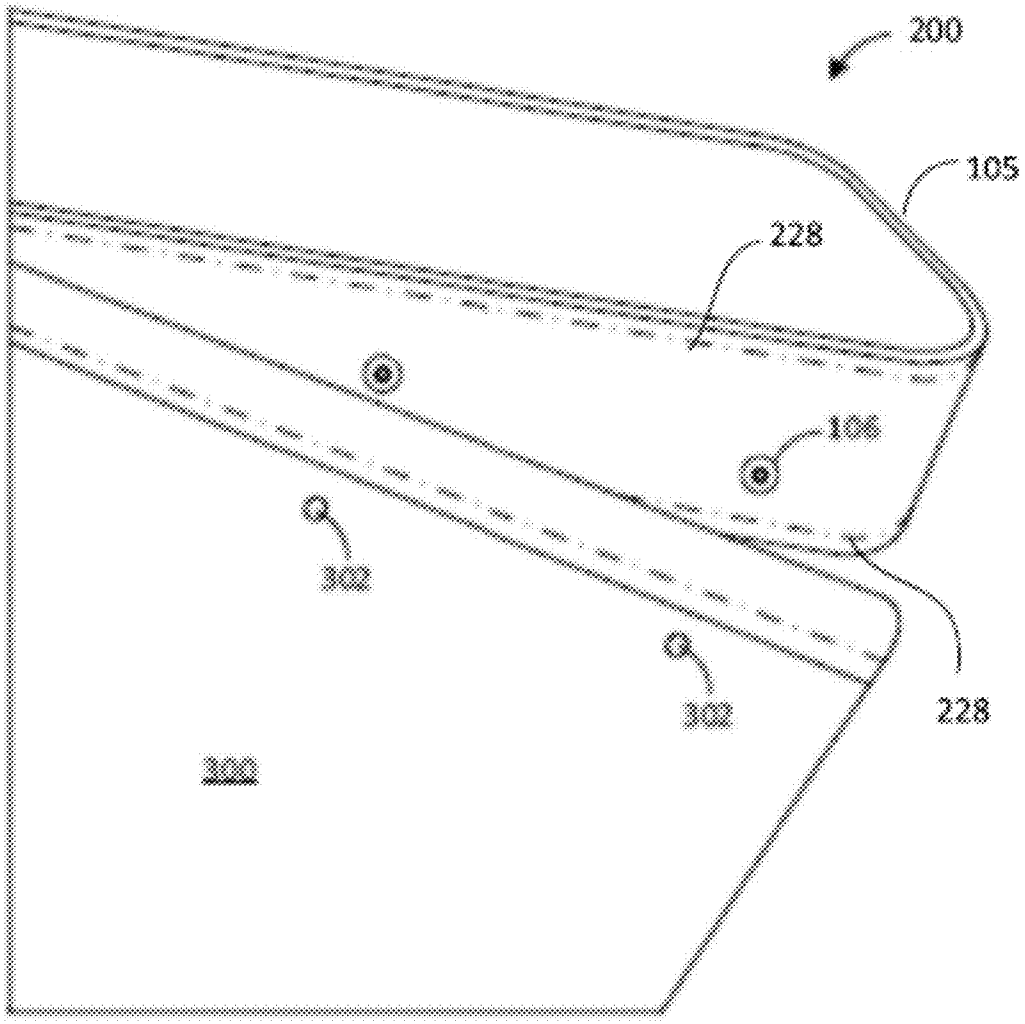
FIG. 10 illustrates a complete tool pouch closure being inserted into a tool pouch.

Referring to FIG. 10, closure 200 may be placed into a pouch 300 with two holes 302 punched through each side of the pouch that align with the mounting holes 106 in the closure.

Figure 11:
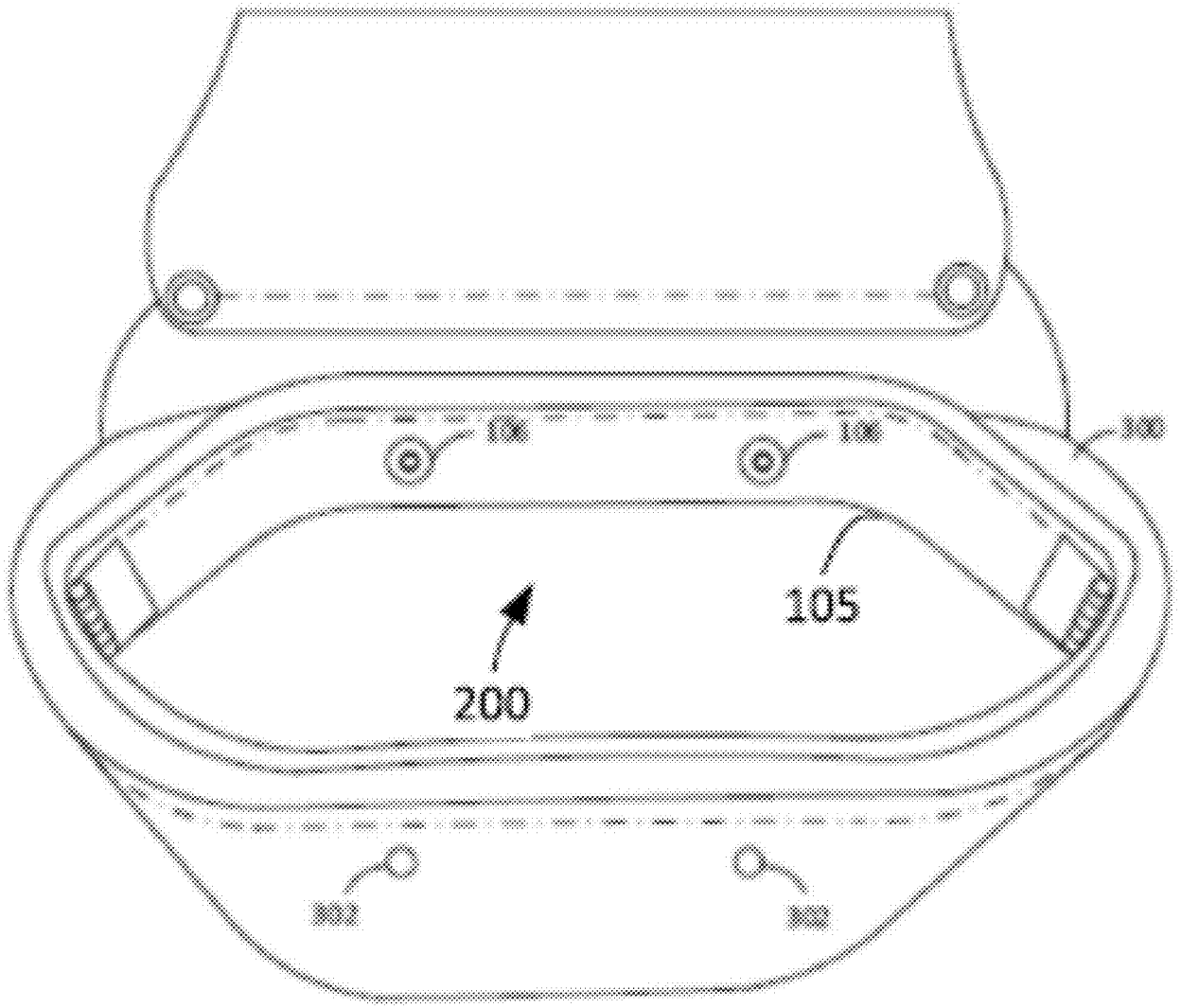
FIG. 11 illustrates a tool pouch closure inserted into a tool pouch prior to securing with fasteners.

Referring to FIG. 11, closure 100 may be placed inside of a tool pouch 300 ready to receive fasteners.

Figure 12:
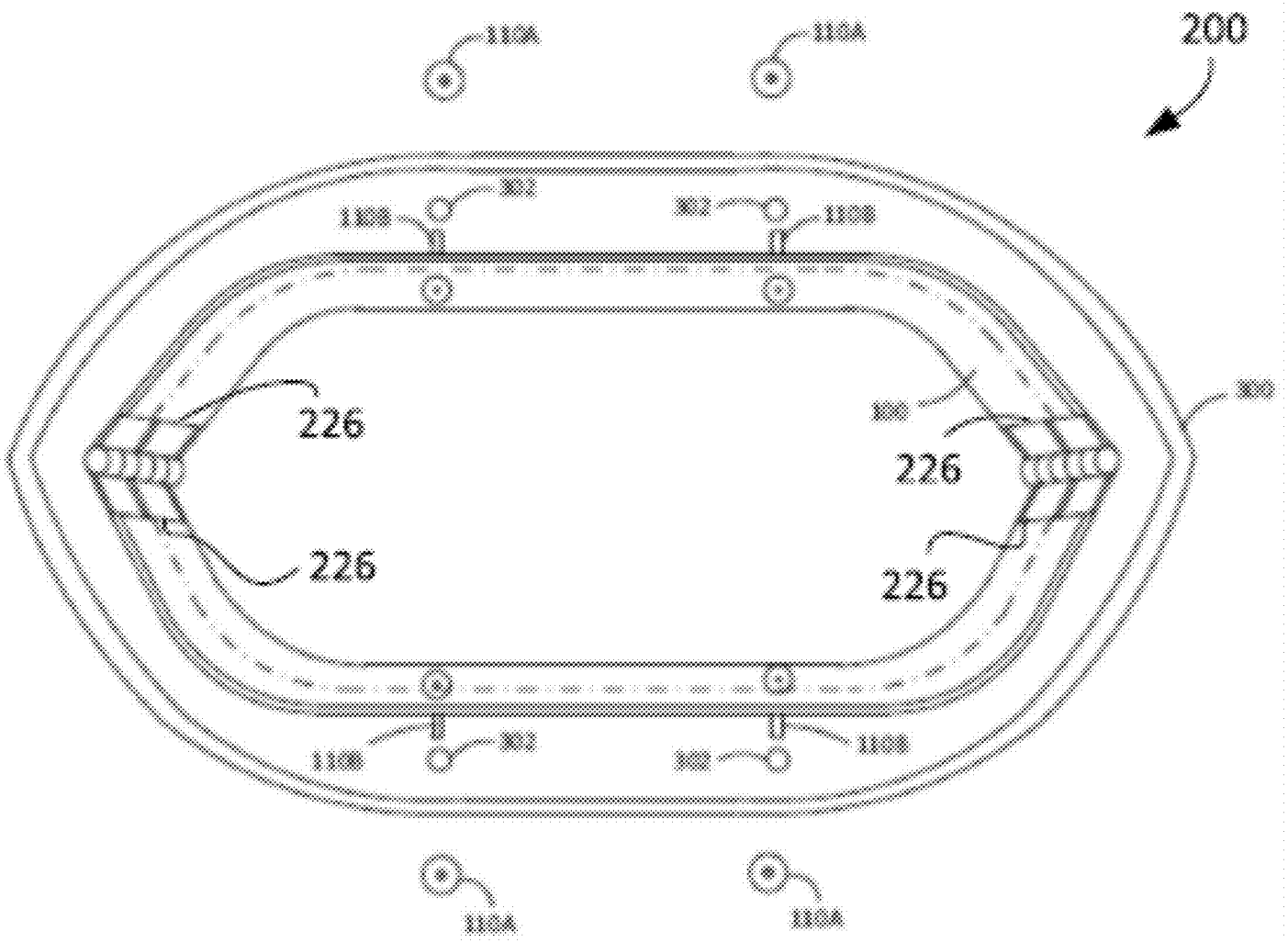
FIG. 12 illustrates a top view of the tool pouch, tool pouch closure, and fasteners.

Referring to FIG. 12, an installation or mounting diagram of the tool pouch closure 100 within a tool pouch 300 demonstrating a preferred method of fastening the closure to the sides of the pouch is illustrated. Two-part removable fasteners 110A and 110B, i.e. Chicago screws, rivets, sex bolts, etc., are inserted through the closure 100 and through the matching holes 302 in the sides of the pouch 300 and are secured. Other structure may be used to secure the closure within the pouch i.e., hook and loop material sewn to the outside of the sleeve and sewn directly into the pouch, by stitching the closure directly to the pouch. The location where the tool pouch closure is fastened and/or secured within the pouch may be to the sides of the pouch (preferably the middle third of each opposing side) to allow the energy of the detent spring hinge with spring bands closure to be focused on the middle of each opposing side of the pouch. This allows the balance of the closure, roughly one third of the length of the closure from the front hinge and one third of the length of the closure from the rear hinge, to move more independently of the pouch. This allows the closure's ends to move more freely inward when the pouch is in the open position and outward when in the closed position. Furthermore, when walking or turning, the inward side of the pouch closest to the body tends to follow the movement of the waist or body while the outward side of the pouch furthest away from the body tends to swing to and fro, from front to back due to the inertia generated from the weight of the contents in the pouch. This floating closure design allows the closure's ends to shift from side to side within the pouch allowing the spring bands to absorb this energy reducing the stress placed on the detent hinges.

Figure 13:
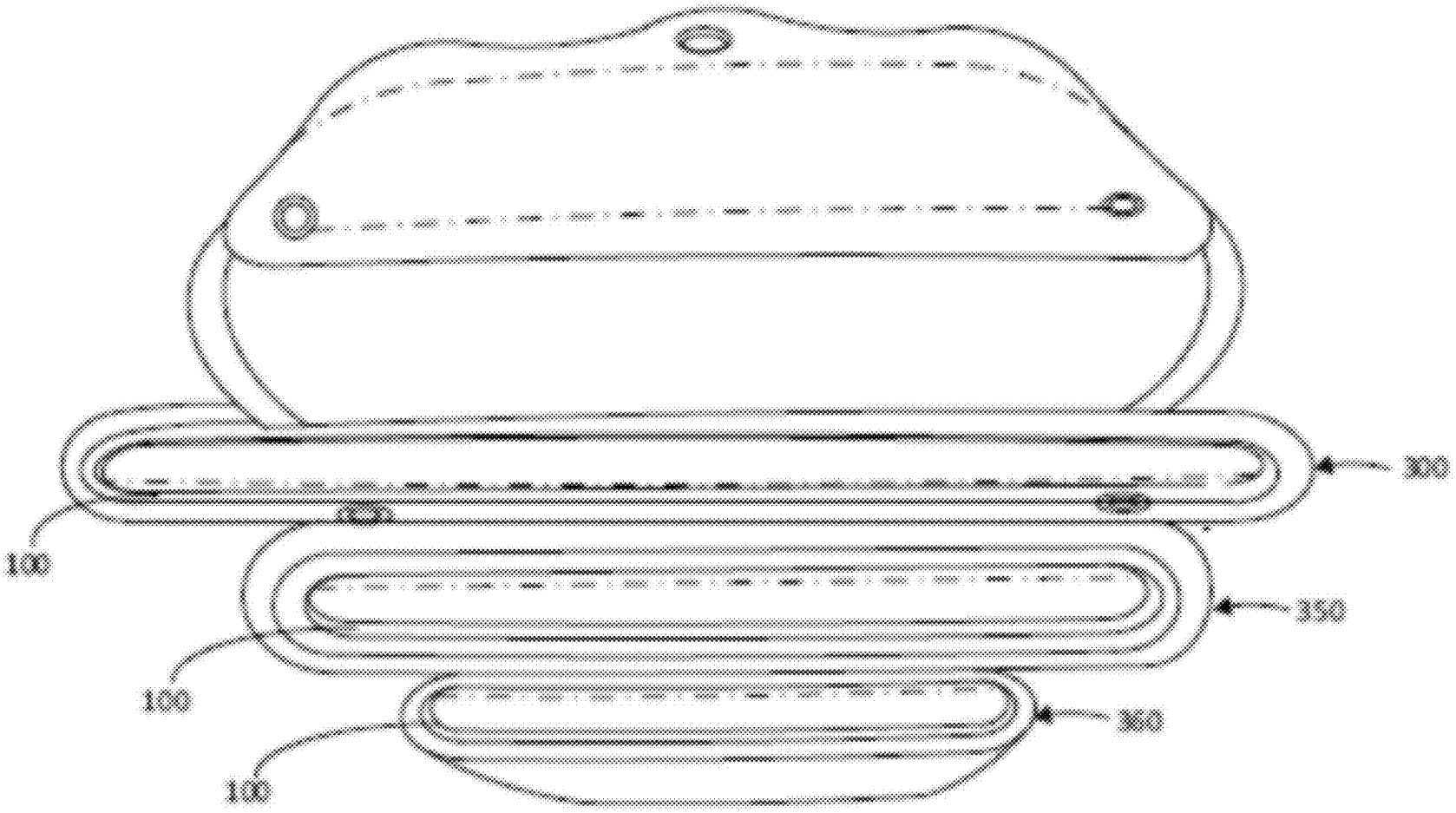
FIG. 13 illustrates a tool pouch assembly in a three-pouch configuration with tool pouch closures installed, with all three pouches in the closed position.

Referring to FIG. 13, the tool pouch assembly is illustrated with a three-pouch configuration 300, 350 and 360 with the tool pouch closures 100 installed, all in the closed position, one closure 100 in each of the three pouches 300, 350, and 360. This illustrates how the tool pouch closures pull the sides of the pouches together, flattening the pouches and preventing the contents of the pouches from spilling out. In other words, the flexible material of the pouch is gathered, that is, brought together to eliminate the opening.

Figure 14:
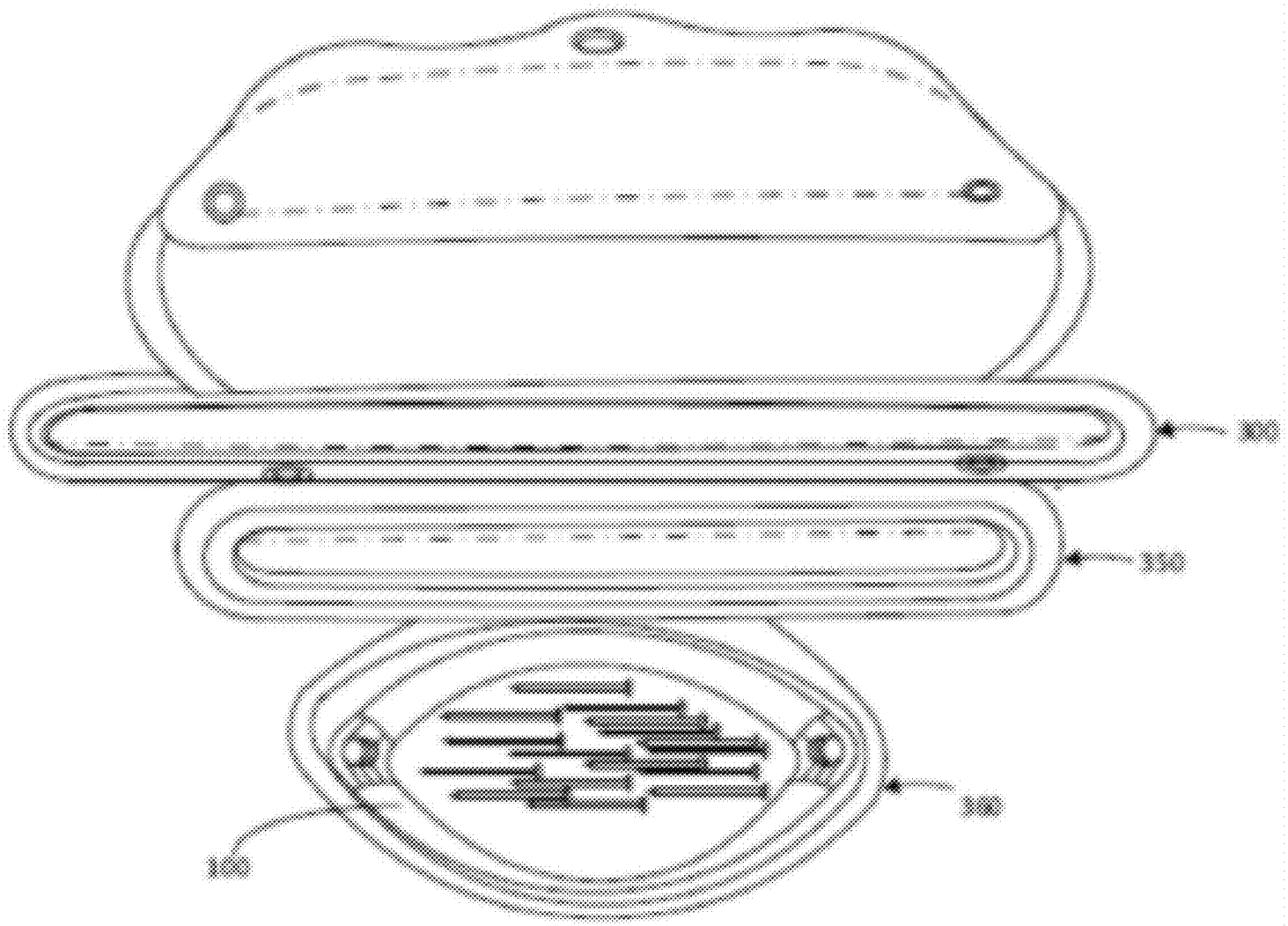
FIG. 14 illustrates a tool pouch assembly in a three-pouch configuration with tool pouch closures installed, with only the small pouch in the open position.

Referring to FIG. 14, the tool pouch assembly in a three-pouch configuration with closures 100 installed is illustrated, showing the larger pouch 300 and the medium size pouch 350 in the closed position, and the small pouch 360 in the open position. This illustrates how a tradesman can selectively open and work from the contents of only a single pouch (e.g., the small pouch 360) thus being more efficient by eliminating access to the items not being used in the other two closed pouches.

Figure 15:
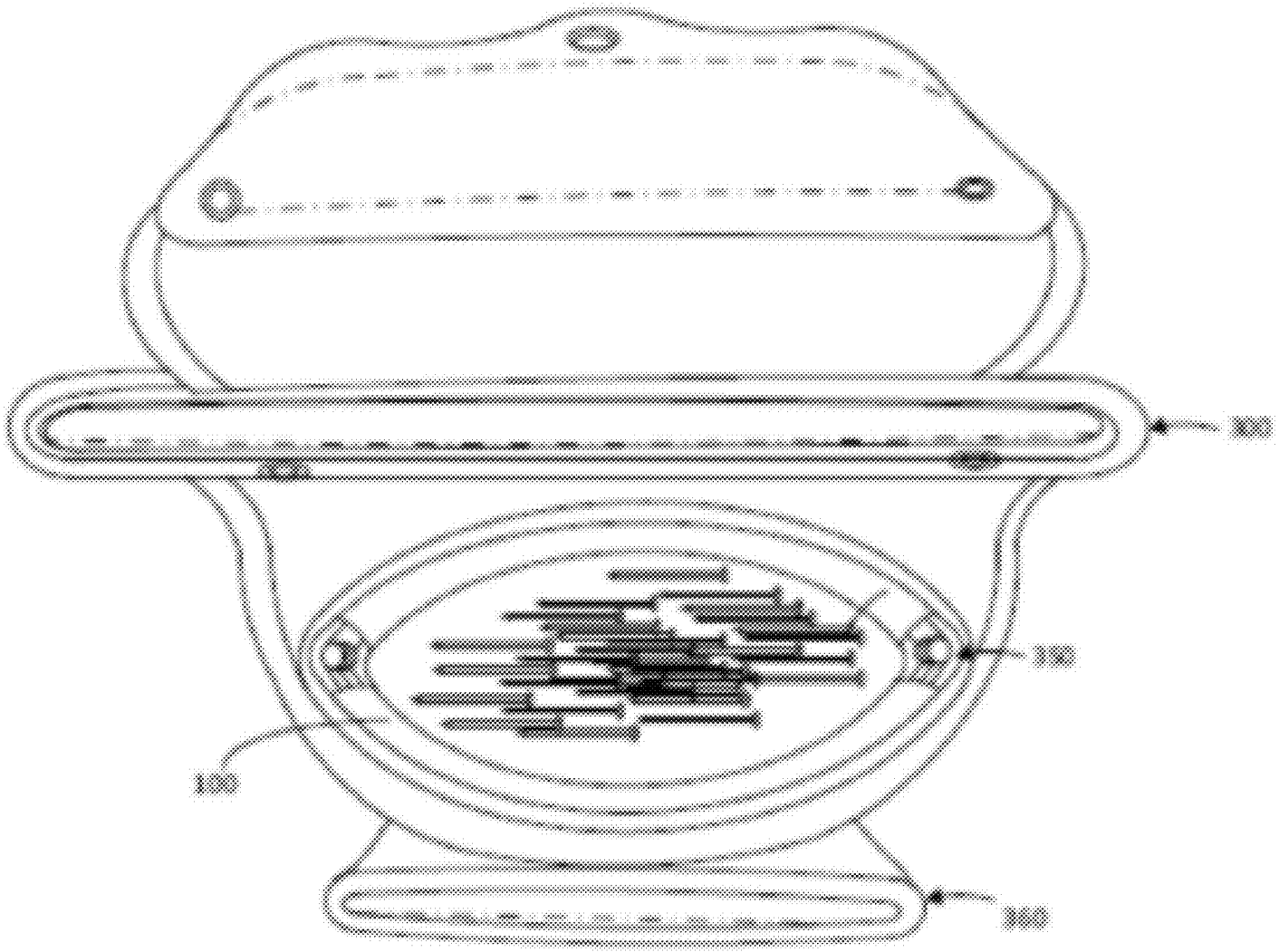
FIG. 15 illustrates a tool pouch assembly in a three-pouch configuration with tool pouch closures installed, with only the medium-sized pouch in the open position.

Referring to FIG. 15, the tool pouch assembly in a three-pouch configuration with closures 100 installed, showing the larger pouch 300, the small pouch 360 in the closed position and the medium sized pouch 350 in the open position is illustrated. This illustrates how a tradesman can open and work from the contents of the medium pouch 350 thus being more efficient by eliminating access to the items not being used in the other two closed pouches.

Figure 16:
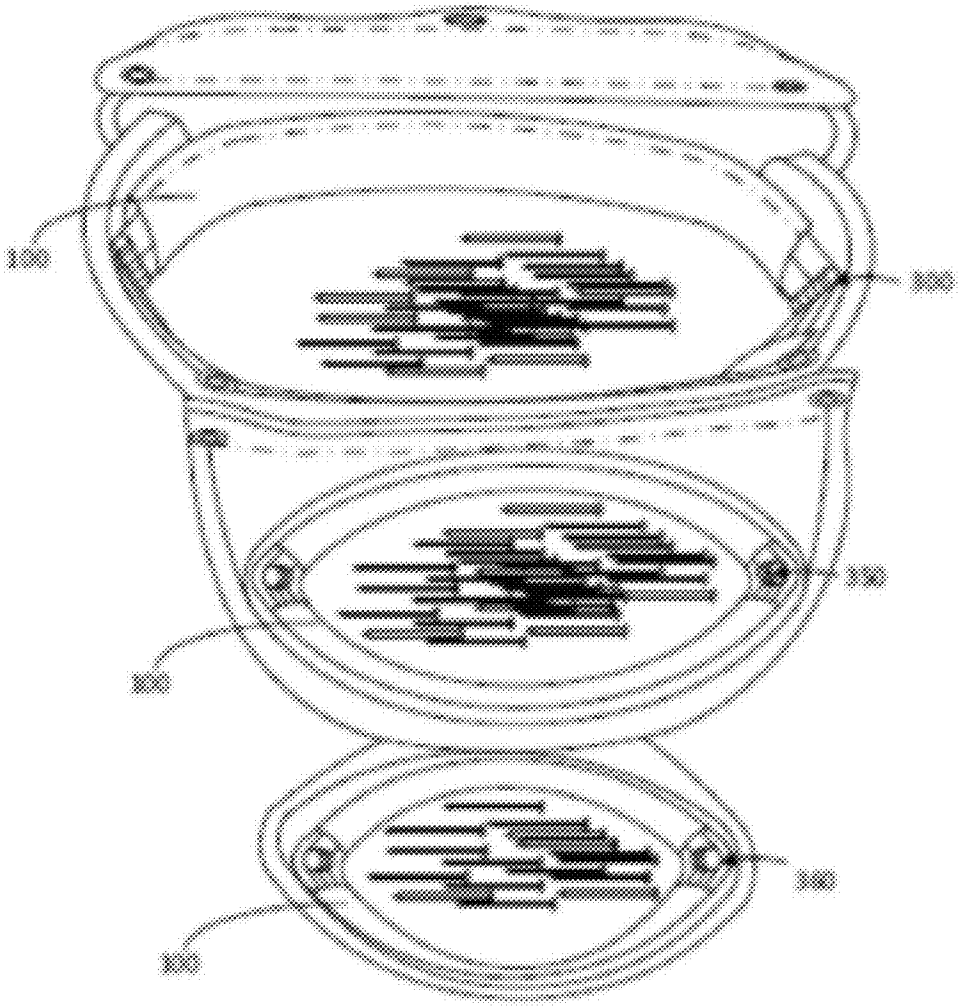
FIG. 16 illustrates a tool pouch assembly in a three-pouch configuration with tool pouch closures installed, with all the tool pouch closures in the open position.

Referring to FIG. 16, the tool pouch assembly in a three-pouch configuration 300, 350 and 360 with closures 100 installed showing all three pouches 300, 350, and 360, in the open position allowing full access to the contents of all three pouches is illustrated.

Figure 17:
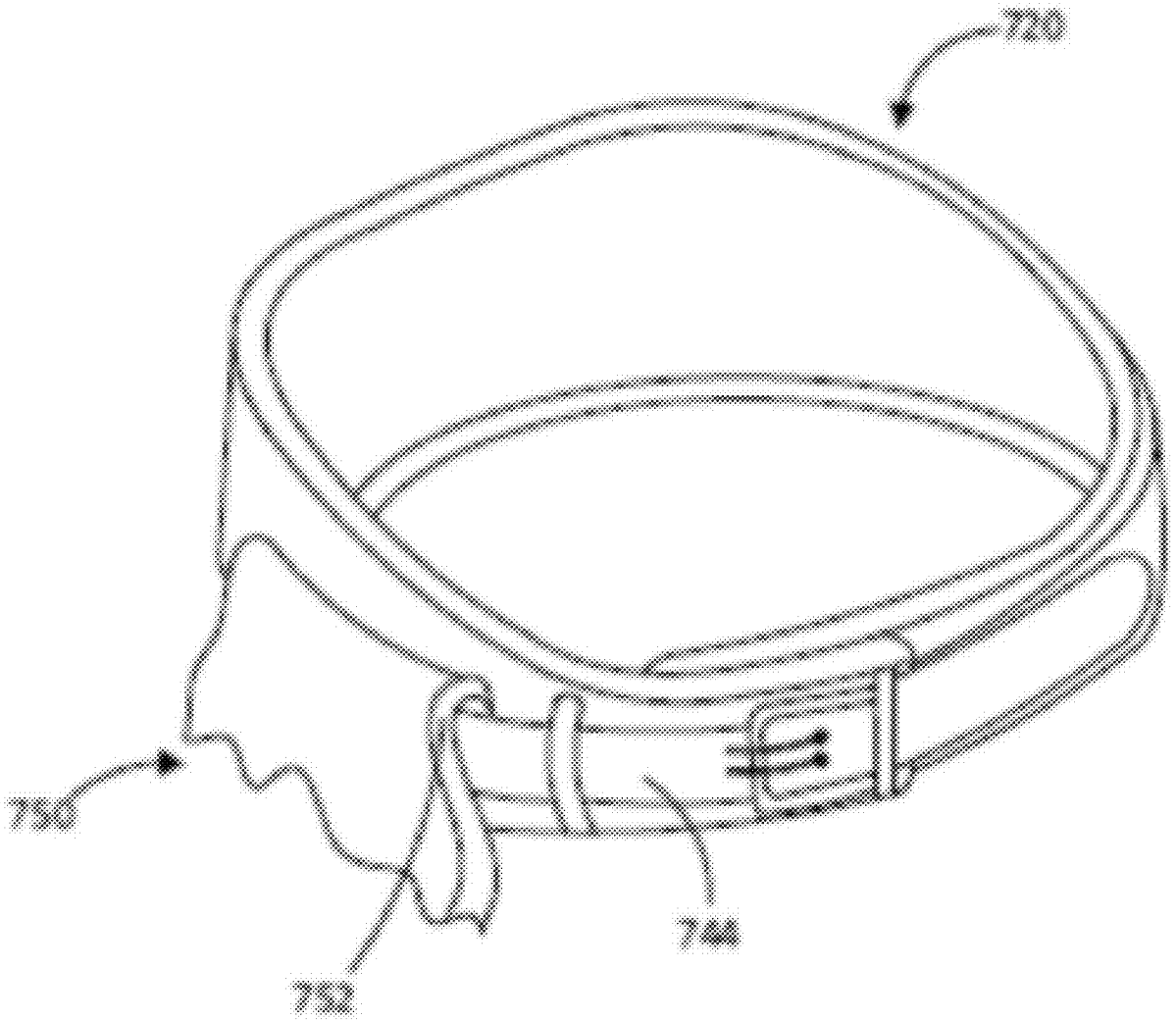
FIG. 17 illustrates a tool belt with a tool pouch attached thereto.

Referring to FIG. 17, a tool belt that is suitable to support the tool pouch(es) comprised of a tool belt assembly 720. A tool pouch 750 (only upper portion is shown) is supported on the strap 744. The pouch 750 may include the pouch loop 752 fitted onto the strap 744. Other interconnections may be used between the pouch 750 and the strap 744 and/or tool belt. It is noted that the tool belt and strap may be integrated components or separate components, as desired.

It is to be understood that the closure assembly, including its cover thereof, may be provided separate from the tool belt and/or the tool pouch. It is to be understood that in the embodiments described above, preferably there are only 2 connections between the closing assembly and the respective side of the tool pouch, with the remainder being not attached to one another.

In general, one or more of the bags (e.g., pouches 300, 350, 360 as in FIGS. 13-16) may be secured, and one or more of the bags may be open so that the contents therein are readily accessible. Also, the tool bag may be modified to include one bag, two bags, three bags, four bags, or more as desired.

In another embodiment, the spring hinge closure may be included within the opening defining a shot shell bag.

In another embodiment, the spring hinge closure may be included within a tool bag. The tool bag typically has a large central opening (with a spring hinge closure included therein) and a set of various sized pouches around substantially the entire periphery of the tool bag.

In another embodiment, the spring hinge closure may be included within a bucket tool bag. The bucket tool bag typically has an upper portion that is suitable for being supported by the upper rim of the bucket.

As previously described, in some embodiments the closure may be constructed with two parallel elongated spring steel bands attached at their ends by detent spring hinges. The steel bands and hinged assembly is then secured with fasteners into a protective sleeve/cover that is made with a wear resistant material such as leather, ballistic nylon, etc.

As previously described in some embodiments, the bands may be made with a very flexible spring steel that is bent longitudinally into a slight V shape adding a defined crease along the entire length of the center of the bands. This crease in the steel and V shape adds dimensional stability and strength when in the straight-closed position. This shape also adds memory to the steel which helps the bands to remain straight when fully extended even after years of continuous flexing. Each of the two bands has two opposing key hole shaped slots positioned approximately one third of the distance in from each hinge. The larger portion of the keyholes allows locations for two eyelets/grommets (one per keyhole) to be installed through both sides of the sleeve and band, securing the closure band within the sleeve, thus preventing the closure from shifting within the sleeve. The two eyelets per band create four mounting locations in total for the closure assembly (two per side). These four eyelet holes fastened on and through the closure provides locations to mount the closure to the pouch with four fasteners. The balance of the keyhole slot works as a break in the V shaped crease, to provide a desired flex location.

As previously described, in some embodiments the installation of this closure device can be achieved by punching four small holes through the pouch (two per side) and installing four fasteners such as Chicago screws, rivets, sex bolts, etc. through the closure and sides of the pouch. This design also allows a defective closure to be quickly and easily replaced. When the closure is fastened to the pouch in this manner, it allows the two hinged sides of the closure to move generally independently of the pouch allowing the closure to focus its energy on the sides of the pouch, pulling the middle of the pouch together and towards the body when closed and pushing the middle of the pouch outward and away from the body when opened. This focus on the center portion of the pouch allows the use of typical exterior attachments to the front and rear of the pouch such as plier holders (sheaths), knife and pencil holders, etc. without hindering the function of the closure.

As previously described, the detent spring hinges used in the tool pouch closure are attached to opposite ends of the steel bands with fasteners, i.e. rivets. They may include an aggressive cam and wider, shorter leaves to require a forceful, determined action to open or close the closure. The hinge is composed of two sides joined in a hinged relationship by cooperatively oriented eyelets for receiving a pivot pin or screw. One side of the hinge is provided with an aggressive knuckle or cam (e.g., 210A as in FIGS. 4-5). The matching side leaf hinge is provided with a resilient tang (e.g., 212B as in FIGS. 4-5) that is cooperative with the detent cam. Opening the hinge requires the tang (leaf spring) to flex up over the angular cam or knuckle and rest on a flat detent, relaxing the tang thus holding the hinge in an open position. To close, the leaf tang again flexes up and over the cam before relaxing into the closed position.

Second Embodiment

FIG. 18 shows an isometric view of a pouch closure 1800 in an open or, in some embodiments, a partly-open position. The closure embodiment illustrates comprises a first closure element 1802 and a second closure element 1812, pivotally connected by bi-stable hinges 1830 and 1832. In some embodiments, only one of hinges 1830 or 1832 may be bi-stable. Bi-stable hinges 1830 and 1830 can be of the same design as hinges 210 as shown in FIG. 5. In some embodiments, elements 1802 and 1812 are rigid.

In the embodiment shown, first closure element 1802 comprises a center section 1804 connected to two end sections 1806 by two curved sections 1808, and second closure element 1812 comprises a center section 1814 connected to two end sections 1816 by two curved sections 1818. In some embodiments, the design aspects of pouch closure 1800 may be determined by the requirements of the tool pouch into which pouch closure 1800 is to be installed. Closure embodiments can be of varying aspect ratios and shapes (rectangular, square, round, oval, etc.). In some embodiments, first and second closure elements 1802 and 1812 may comprise a plurality of rigid straight sections. In some embodiments, some of these rigid straight sections may be connected by rigid curved sections. In some embodiments, first and second closure elements 1802 and 1812 may have circular, oval, or elliptical shapes.

In some embodiments, the materials used to fabricate first closure element 1802 and second closure element 1812 may comprise a rod, that is, a rigid solid wire-like structure. The rod may be solid or have a rigid hollow tubular form. The cross-sectional shapes of the solid wire-like or rigid hollow tubular material may be rectangular, square, round, oval, etc., and wherein a range of cross-sectional shapes fall within the scope of the invention. In the embodiment of FIGS. 1-17, the closure structure would bend as the bag moved between the open and closed position, and the strap structure accommodates the bending. In the embodiment of FIG. 18, the rod is not required to bend, and so can be thicker and stiffer. Compared to the straps that compose the closure in the previously described embodiments, the closure structure in the embodiment of FIG. 18 is typically thicker, having a thickness of greater than $\frac{1}{8}^{th}$ of an inch and preferably greater than 3/16 of an inch. The closure structure also preferably has a smaller aspect ratio, that is, the ratio of thickness to width, compared to the embodiments described above that use a "strap," also referred to as a "band" rather than a "rod." The aspect ratio of a rod in this embodiment is typically less than 3:1, and preferably less than 2:1. Some embodiments use a solid rod having a circular cross-section with a diameter of between 1/8 inch and 1/2 inch. In some embodiments, closure elements 1802 and 1812 may be fabricated from metal or other strong and durable materials. In some embodiments, closure elements 1802 and 1812 may comprise rigid solid wires or rigid hollow tubing, and the ends of closure elements 1802 and 1812 (see FIG. 21) which attach to bi-stable hinges 1830 and 1832 may have a different cross-sectional shape than sections 1804-1808 and 1814-1818, to facilitate a stronger or easier attachment of bi-stable hinges 1830 and 1832 to sections 1806 and 1816, respectively. In some embodiments, first closure element 1802 and second closure element 1812 may be identical or may be mirror-imaged, while in other embodiments first closure element 1802 may comprise a different shape, and/or different material, and/or materials with differing cross-sectional shapes, than are comprised in second closure element 1812.

Bi-stable hinge 1830 is shown in FIG. 18 holding pouch closure 1800 in an open (or partly-open) position without the need for the user to perform any manual locking operation to maintain the open position. In the illustration, the opening angle between closure elements 1802 and 1812 is approximately 90°, however other opening angles are determined by the design of bi-stable hinge 1830 could be used. The opening angle is preferably less than 180° to facilitate opening the pouch with one hand. The larger the angle, the wider the opening (out to 180°). A larger opening may be more difficult to move into the stable open position using one hand. An angle of greater than 180° can also be used. Bi-stable hinges 1830 and hinge 1832 may work in tandem to hold the pouch closure 1800 in an open position. Bi-stable hinges 1830 and 1832 both have rotation axes, which in some embodiments are generally co-linear with pivot (hinge) rotation axis 1834.

To move from the open position to the closed position, bi-stable hinges 1830 and 1832 move downward away from the opening. When in the open position, closure 1800 spreads the flexible material of the pouch to create an opening at the top of the pouch for inserting items into, and removing items from, the pouch. In the closed position, the flexible material is gathered to close the opening at the top of the pouch to keep items within the pouch.

A user moving the center sections 1804 and 1814 together to close the pouch causes bi-stable hinges 1830 and 1832 to move downward toward the bottom of the pouch. Bringing center portions 1804 and 1814 together gathers the flexible material at the top to close the pouch and bi-stable hinges 1830 and 1832 maintain the pouches in the closed position. When the user moves the center sections 1804 and 1814 apart to open the pouch, bi-stable hinges 1830 and 1832 move upward. Center sections 1804 and 1814 separate the flexible material to open the pouch and bi-stable hinges 1830 and 1832 maintain the pouch in the open position. As center sections 1804 and 1814 move apart or together to open and close the pouch, bi-stable hinges 1830 and 1832 move up and down. As bi-stable hinges 1830 and 1832 move up and down, their pivot axes remain co-linear, that is, a line (e.g., axis 1834) through the pivot axis of one of bi-stable hinges 1830 and 1832 passes through the pivot axis of the other one of bi-stable hinges 1830 and 1832.

FIG. 19 shows an isometric view of pouch closure 1800 of FIG. 18 in a closed position. Bi-stable hinges 1830 and/or 1832 are holding pouch closure 1800 closed in this illustration without the need for a user to perform any manual locking, latching, or sealing operation (i.e., zippers, snaps, buttons, hooks, etc.).

Bi-Stable Spring Hinge

Figure 20:
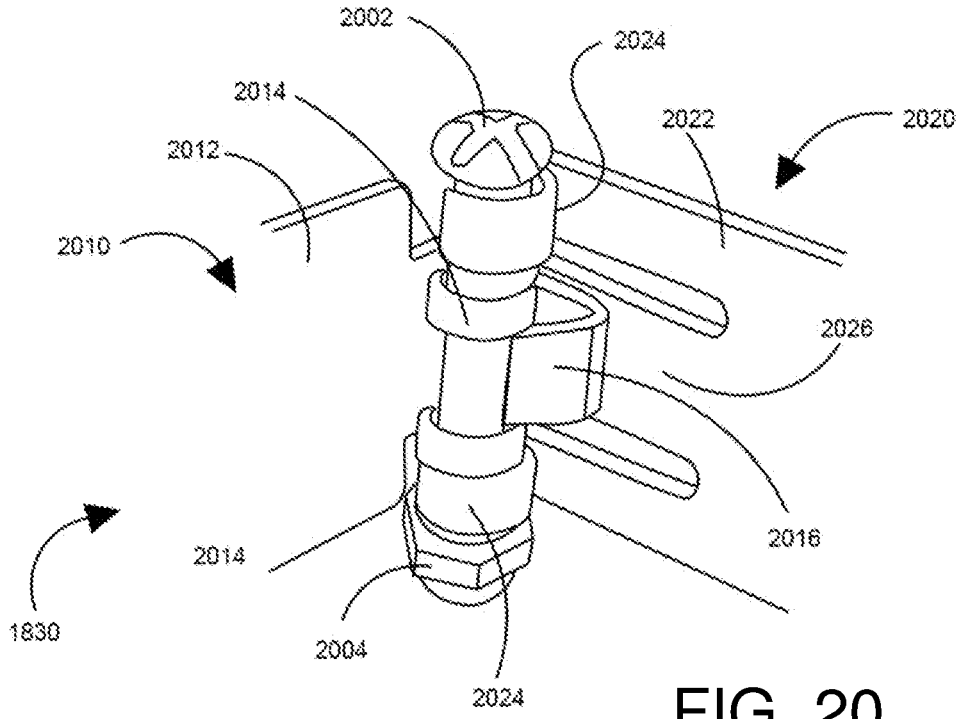
FIG. 20 shows an isometric view of a bi-stable spring hinge.

FIG. 20 shows an isometric view of bi-stable spring hinge 1830 with an over-center cam spring mechanism, comprising a cam side 2010 and a spring side 2020. Bi-stable hinge 1832 may be identical to bi-stable hinge 1830 as shown here. Cam side 2010 comprises a cam side body 2012, two cam side locators 2014, and a cam 2016. Spring side 2020 comprises a spring side body 2022, two spring side locators 2024, and a spring or tang 2026. The bi-stable operation of the hinge is effected by the interaction of cam 2016 with spring 2026, as illustrated in FIGS. 22A-22D. The function of the two cam side locators 2014 and the two spring side locators 2024 is shown in FIG. 20—locators 2014 and 2024 fit around a hinge pivot pin (screw) 2002 which is locked into place within bi-stable hinge 1830 by a hinge pivot retainer 2004. As bi-stable hinge 1830 opens and closes, locators 2014 and 2024 maintain the relative spacing of cam side 2010 and spring side 2020 to enable a proper interaction of cam 2016 with spring 2026 (see FIGS. 22A-22D).

Figure 21:
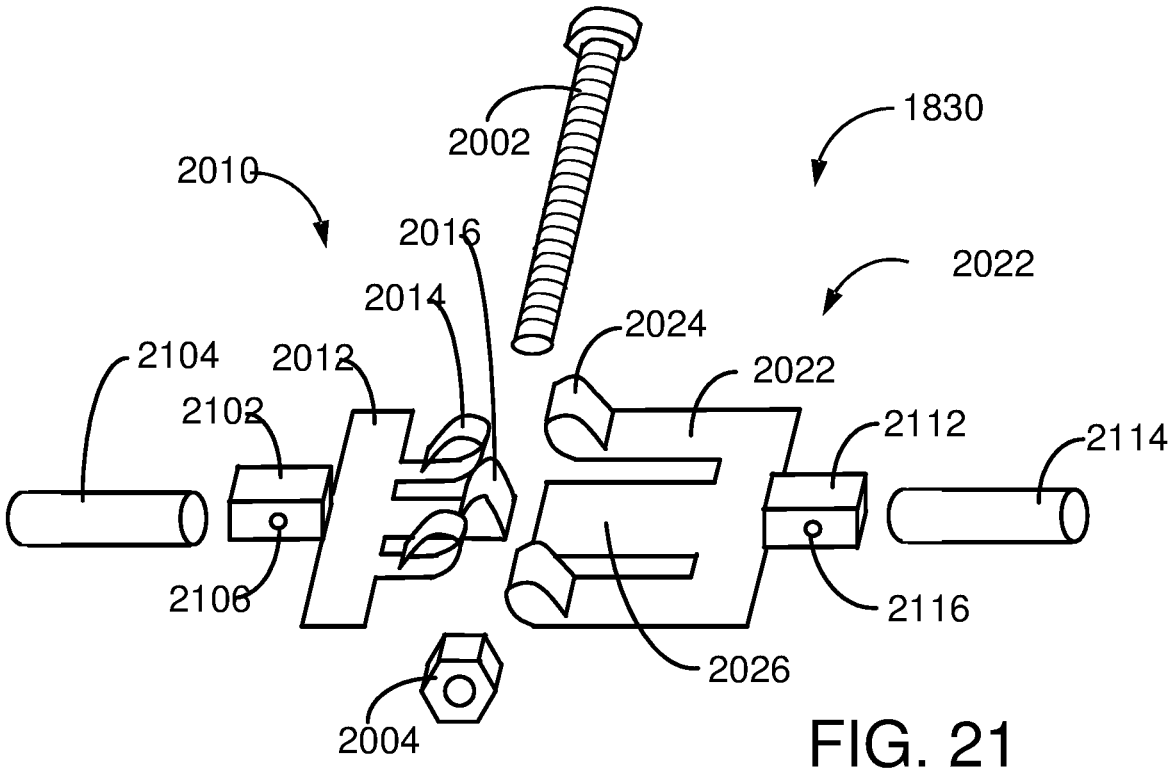
FIG. 21 shows an isometric exploded view of the bi-stable spring hinge.

FIG. 21 shows an isometric exploded view of bi-stable hinge 1830 in FIG. 20. A sequence of steps for assembling bi-stable hinge 1830 may be as follows:

1) Hinge pivot pin 2002 slides through the upper (as illustrated in FIG. 21) spring side locator 2024.
2) Hinge pivot pin 2002 slides through the upper cam side locator 2014. At this point, cam 2016 may be in contact with spring 2026.
3) Hinge pivot pin 2002 slides through the lower cam side locator 2014.
4) Hinge pivot pin 2002 slides through the lower spring side locator 2024.
5) Hinge pivot pin 2002 is then pushed farther through both cam side locators 2014 and both spring side locators 2024 until the head of hinge pivot pin 2002 is in contact with the edge of the upper spring side locator 2024 (see FIG. 20).
6) Hinge pivot retainer 2004 is then attached to the exposed end of hinge pivot pin 2002 to prevent hinge pivot pin 2002 from coming out of the now-assembled bi-stable hinge 1830. Pivot pin 2002 may be a screw, in which case hinge pivot retainer 2004 may be a locknut. Pivot pin 2002 may comprise a smooth pin, in which case hinge pivot retainer may be attached by crimping, soldering, welding, gluing, or some other method. For proper long-term functioning of bi-stable hinge 1830, it is important that hinge pivot retainer not come off, so a permanent attachment of hinge pivot retainer 2004 to hinge pivot pin 2002 may be preferred.

Bi-stable hinge 1830 has two mounting sockets 2102 and 2112, into which an end 2104 of first closure element 1802, and an end 2114 of second closure element 1812, may be inserted and attached. In other embodiments, end 2104 may correspond to second closure element 1812, in which case, end 2114 may correspond to first closure element 1802. In embodiments, attachment may be effected by set screws 2106 and 2116, respectively. In other embodiments, ends 2104 and 2114 may be glued, soldered, welded, crimped, or attached some other way into mounting sockets 2102 and 2112. To improve the strength of the attachment of ends 2104 and 2114 to mounting sockets 2102 and 2112, respectively, the shapes of ends 2104 and 2114 may be configured to better match the interior shapes of mounting sockets 2102 and 2112—this may be effected by crimping, machining, filing, etc., of ends 2104 and 2114. Thus, for example, in embodiments, although the cross-sectional shapes of sections 1804-1808 and/or sections 1814-1818 in FIGS. 18 and 2 may be round or another non-square shape, ends 2104 and 2114 may be reformed into more squared cross-sectional shapes to improve attachment strengths to mounting sockets 2102 and 2112

Figure 22A:
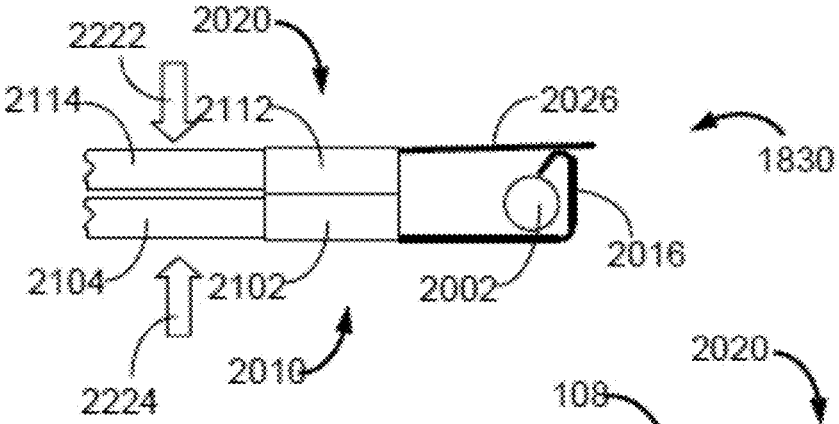
FIGS. 22A-22D show schematic views of the operation of the bi-stable spring hinge.
Figure 22B:
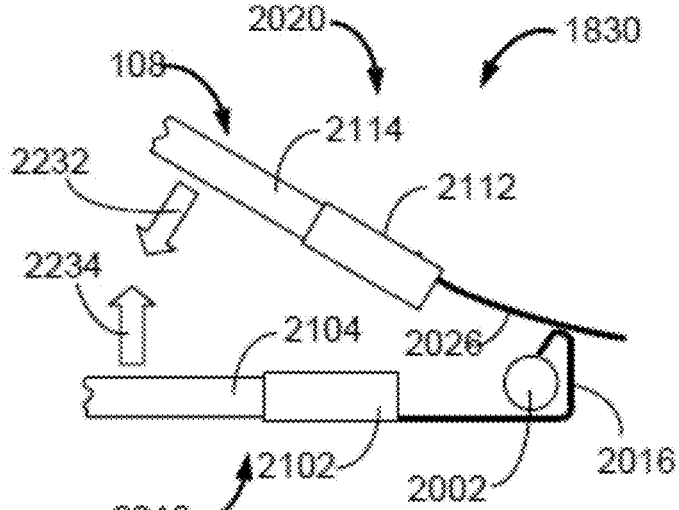
Figure 22C:
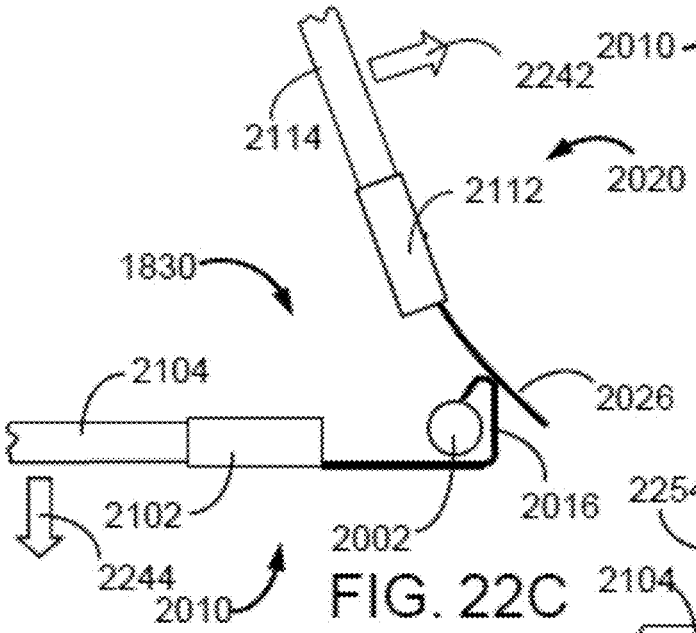
Figure 22D:
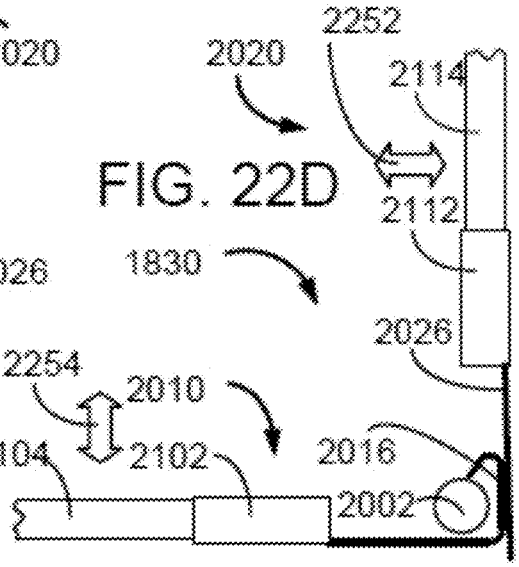

FIGS. 22A-22D show schematic views of the operation of bi-stable hinge 1830, going from being held fully closed (FIG. 22A) to being held fully open (FIG. 22D).

FIG. 22A shows bi-stable hinge 1830 in a fully-closed position as shown in FIG. 19. Spring or tang 2026 is pressing against cam 2016, inducing closing forces 2222 and 2224 on spring side 2020 and cam side 2010, respectively. This position may be reached by closing the tool pouch from a slightly open position (e.g., as illustrated in FIG. 22B).

FIG. 22B shows bi-stable hinge 1830 in a slightly-open position in which bi-stable hinge 1830 would be exerting a closing force on a pouch closure (shown by ends 2104 and 2114)—this position may be reached while opening the tool pouch from a fully-closed position (e.g., as illustrated in FIG. 22A) and while closing the tool pouch from an almost-open position (e.g., as illustrated in FIG. 22C). Spring 2026 is pressing against cam 2016, inducing closing forces 2232 and 2234 on spring side 2020 and cam side 2010, respectively.

FIG. 22C shows bi-stable hinge 1830 in an almost-open position in which the bi-stable hinge is exerting an opening force on the pouch closure (shown by ends 2104 and 2114)—this position may be reached while opening the tool pouch from a slightly-open position (FIG. 22B) and while closing the tool pouch from a fully-open position (FIG. 22D). Spring 2026 is pressing against cam 2016 nearer the flat side of cam 2016, inducing a force which is tending to induce spring 2026 to slide downwards towards the flat side of cam 2016, thereby inducing opening forces 2242 and 2244 on spring side 2020 and cam side 2010, respectively.

FIG. 22D shows bi-stable hinge 1830 in a fully open position as in FIG. 18. Spring 2026 is pressing against the flat side of cam 2016 as shown, tending to maintain the angle shown between spring side 2020 and cam side 2010. The angle of an opening between cam side 2010 and spring side 2020 is determined by the shape of cam 2016—as pictured here, cam 2016 is configured to maintain approximately a 90° opening angle. In other embodiments, cam 2010 may be shaped to maintain larger (greater than 90°) or smaller (less than 90°) opening angles between cam side 2010 and spring side 2020. Position-maintaining forces 2252 and 2254 will be induced on spring side 2020 and cam side 2010, respectively, if external forces are exerted on bi-stable hinge 1830 tending to either increase or decrease the angle between cam side 2010 and spring side 2020—if bi-stable hinge 1830 is pulled more open, forces 2252 and 2254 will oppose the opening force, while if bi-stable hinge 1830 is pushed more closed, forces 2252 and 2254 will oppose the closing force. This position may be reached by opening the tool pouch from an almost open position (FIG. 22C).

Other arrangements of the cam 2016 and spring 2026 demonstrating a similar bi-stable behavior also fall within the scope of the invention.

Tool Pouch with Bi-Stable Spring Closures

Figure 23:
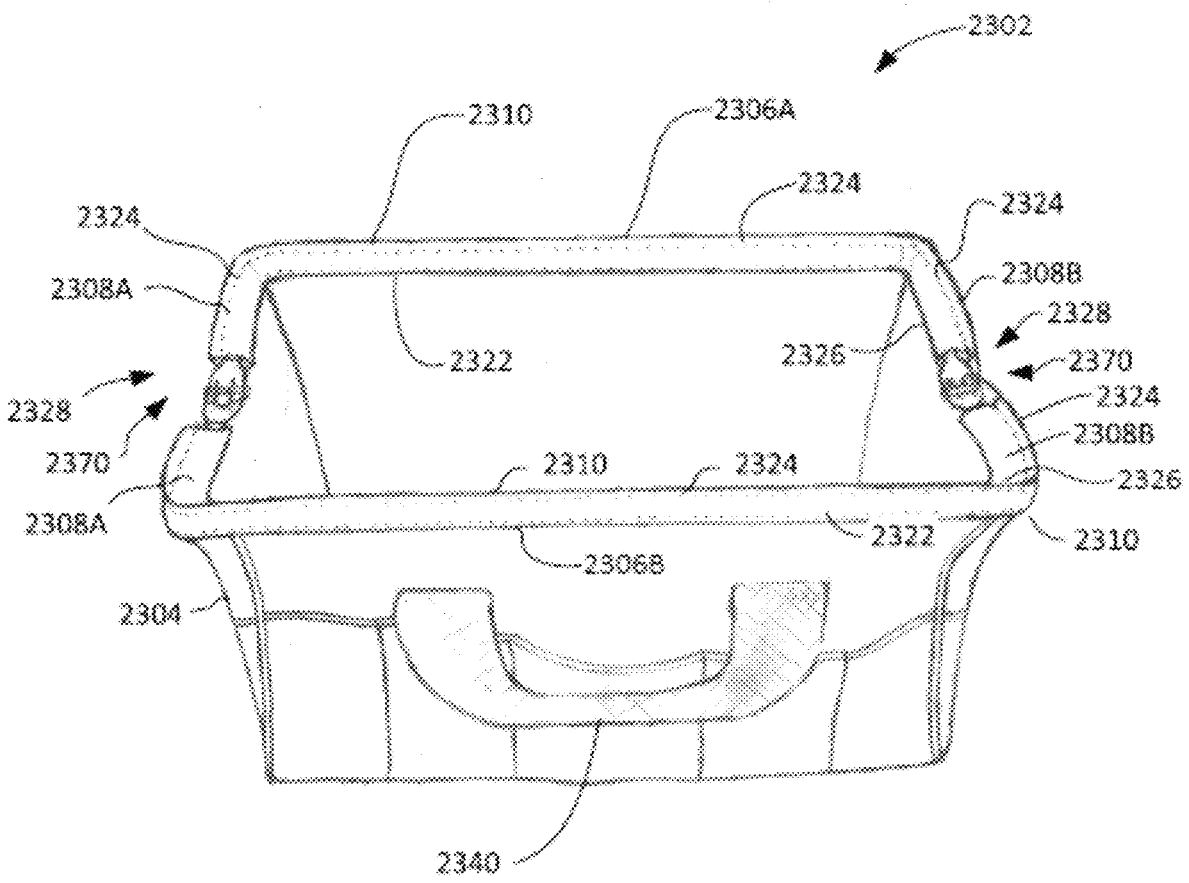
FIG. 23 shows a single-pouch assembly in an open position.

FIG. 23 shows a pouch assembly 2302 that includes a spring closures 2328 and a pouch 2304 having 2 long sides 2306A and 2306B (referred to collectively as long sides 2306), two short sides 2308A, and two short sides 2308B (sides 2308A and 2308B are referred to collectively as short sides 2308). Sleeve 2310 is attached to pouch 2304, preferably by sewing. Sleeve 2310 may be formed, for example, by folding a two-inch ribbon of cloth in half to form a one-inch sleeve. Along the long sides 2306 of pouch 2304, sleeve 2310 is sewn to pouch 2304 at both the top 2324 and bottom 2322 of sleeve 2310. Along the short sides 2308 of pouch 2304, sleeve 2310 is preferably only sewn to pouch 2304 at the top 2324 of sleeve 2310, wherein leaving the bottom 2326 of sleeve 2310 free (i.e., unstitched to pouch 2304) on the short sides 2308 provides an additional degree of freedom for sleeve 2310 to move as spring closures 2328 are opened and closed. Sleeve 2310 has openings 2370 near the centers of short sides 2306 that allow closures 2328 to extend out of sleeve 2310, thereby facilitating opening and closing of closures 2328. Pouch assembly 2302 may include a handle 2340 on each side, with only one visible in FIG. 23

Figure 24:
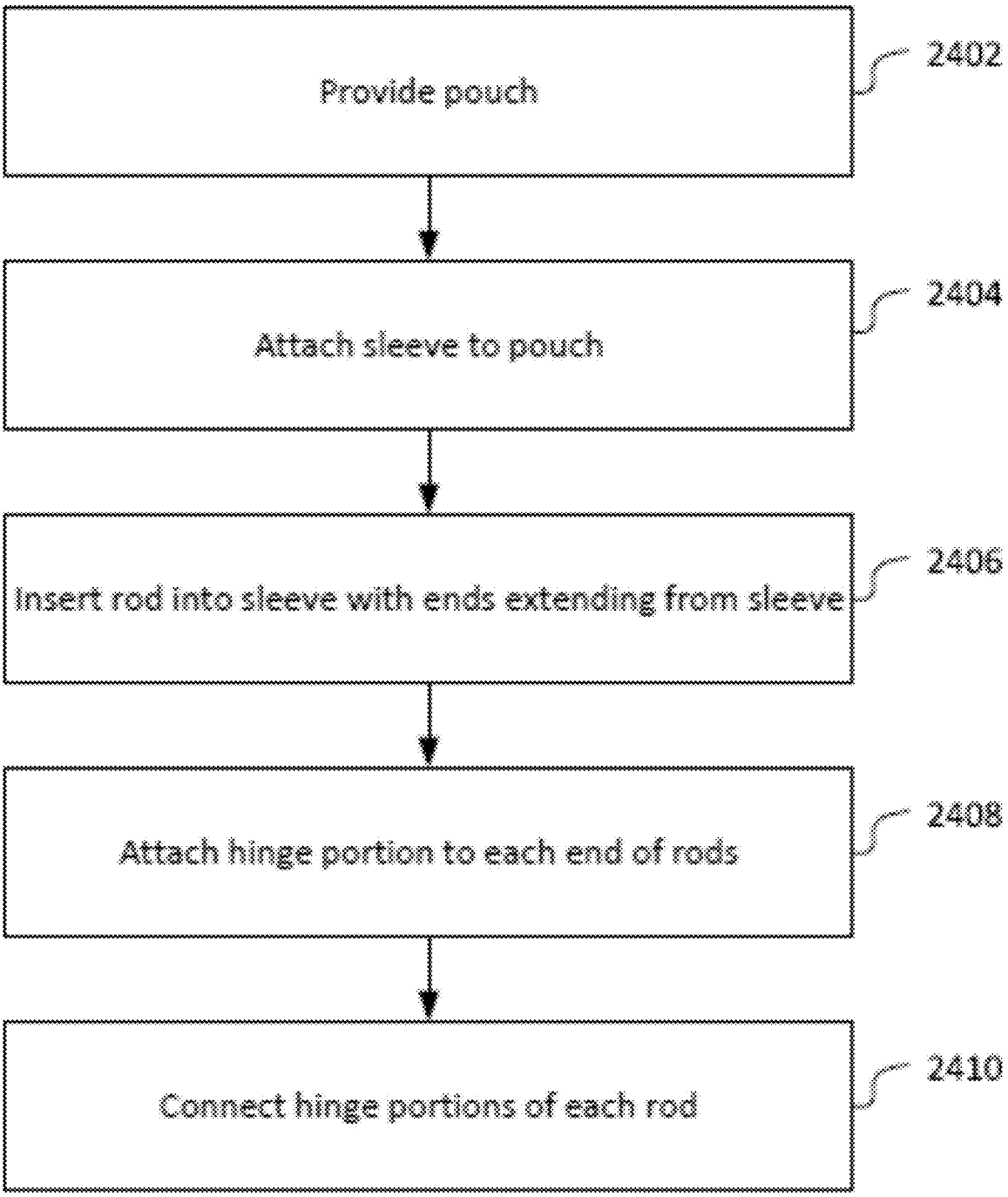
FIG. 24 is a flowchart showing how the pouch assembly of FIG. 23 may be constructed.
Figure 25:
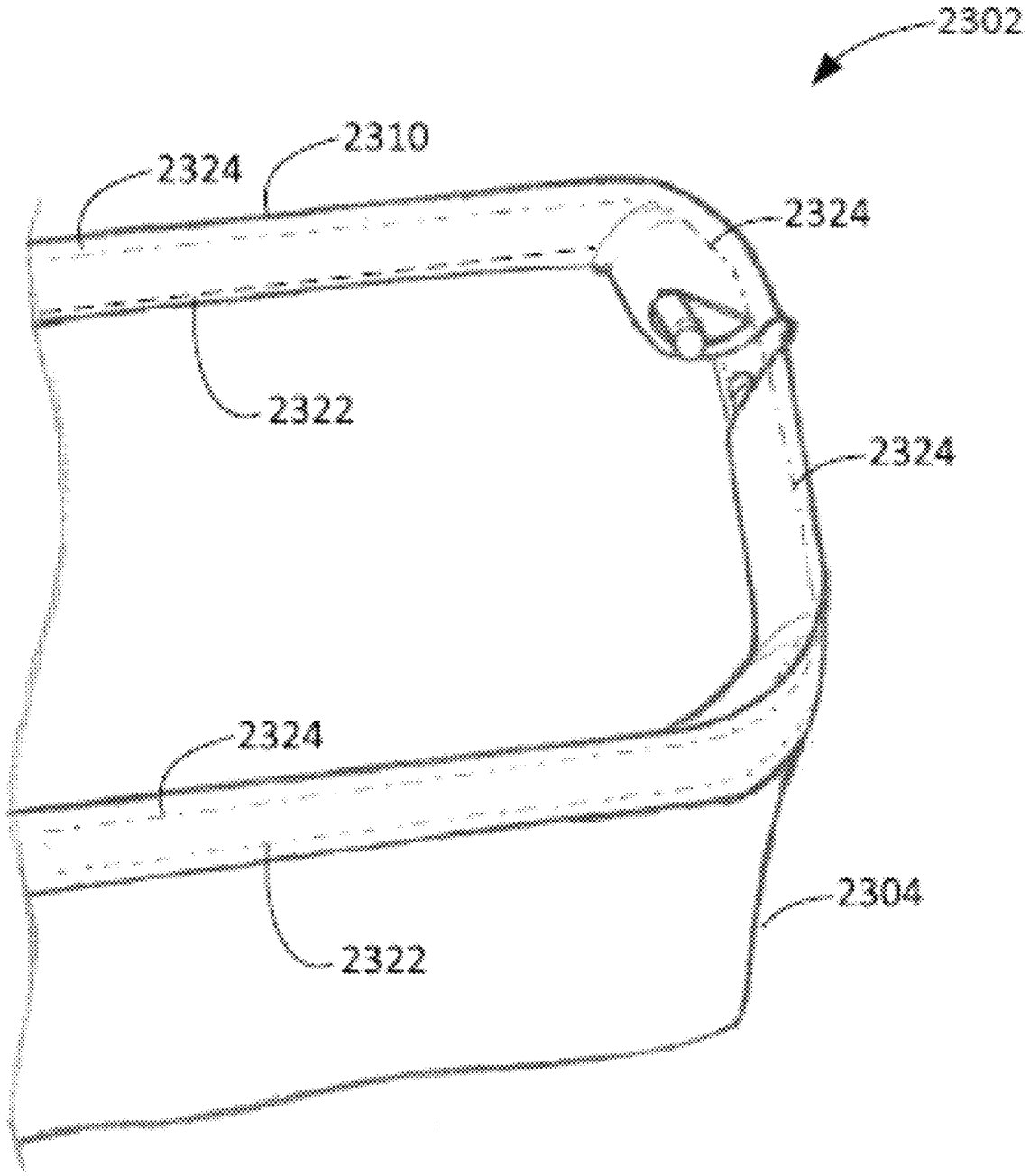
FIG. 25 shows one side of the pouch assembly of FIG. 23.

FIG. 24 is a flow chart showing how the pouch assembly 2302 is constructed. In step 2402, a pouch 2304 is provided. Pouch 2304 is preferably composed of a durable material, such as leather, canvas, or nylon. The material may be, for example, a multi-ply material so that the interior is smooth and tear resistant and the exterior is tear resistant and waterproof. In step 2404, sleeve 2310 is attached to pouch 2304 by sewing the top portion 2324 of the sleeve to the pouch along the entire length of the sleeve. Sleeve 2310 may be constructed in two parts, and a first part may be attached to one side of the pouch and the second part may be attached to the opposite side of the pouch. Each sleeve part may extend toward the center of the short side, stopping prior to the center at a sufficient distance to allow a hinge to be connected to the ends of sides 1803 and 1812 (e.g., rod ends 2104 and 2114 in FIG. 21), and preferably allowing the hinge to be exposed. In step 2406, a rod is inserted in each part of the sleeve, with the ends of the rods (e.g., rod ends 2104 and 2114 in FIG. 21) extending out of the sleeve near the center of the short side. FIG. 25 shows one side of pouch assembly 2302. In step 2408, a hinge portion is connected to each end of the rod extending out of the sleeve (see FIG. 20). In step 2410, the hinge portions on each end of the rod are connected together by insertion of a hinge pin (see FIG. 21).

In some embodiments, the sleeve may be constructed as a single sleeve that goes all the way around the inside of the pouch, with slits cut into the sleeve to allow the ends of the rods (e.g., rod ends 2104 and 2114 in FIG. 21) to extend out of the slit and be connected to the hinge portions.

Figure 26:
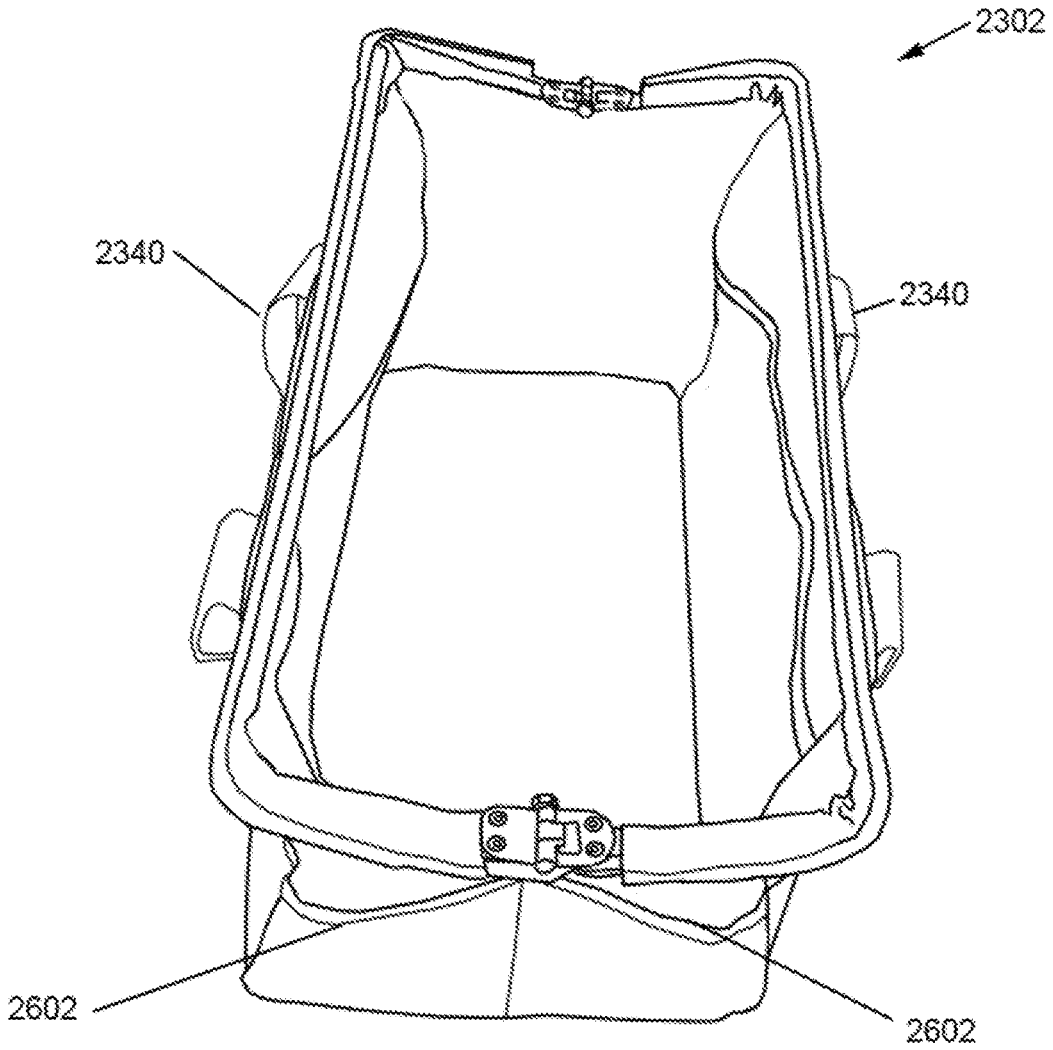
FIG. 26 shows a top end view of the pouch assembly of FIG. 23.
Figure 27:
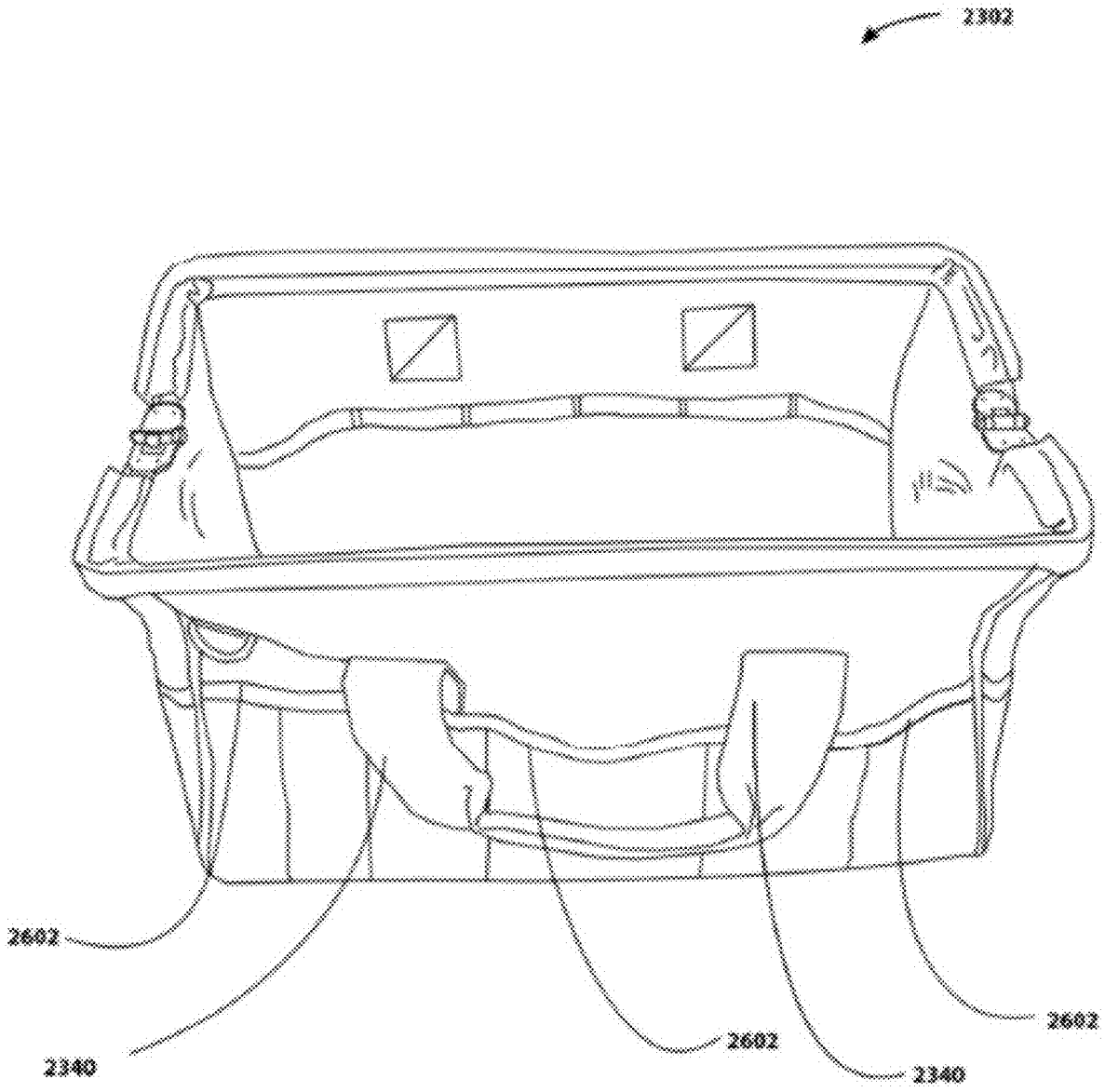
FIG. 27 shows a top front view of the pouch assembly of FIG. 23.
Figure 28:
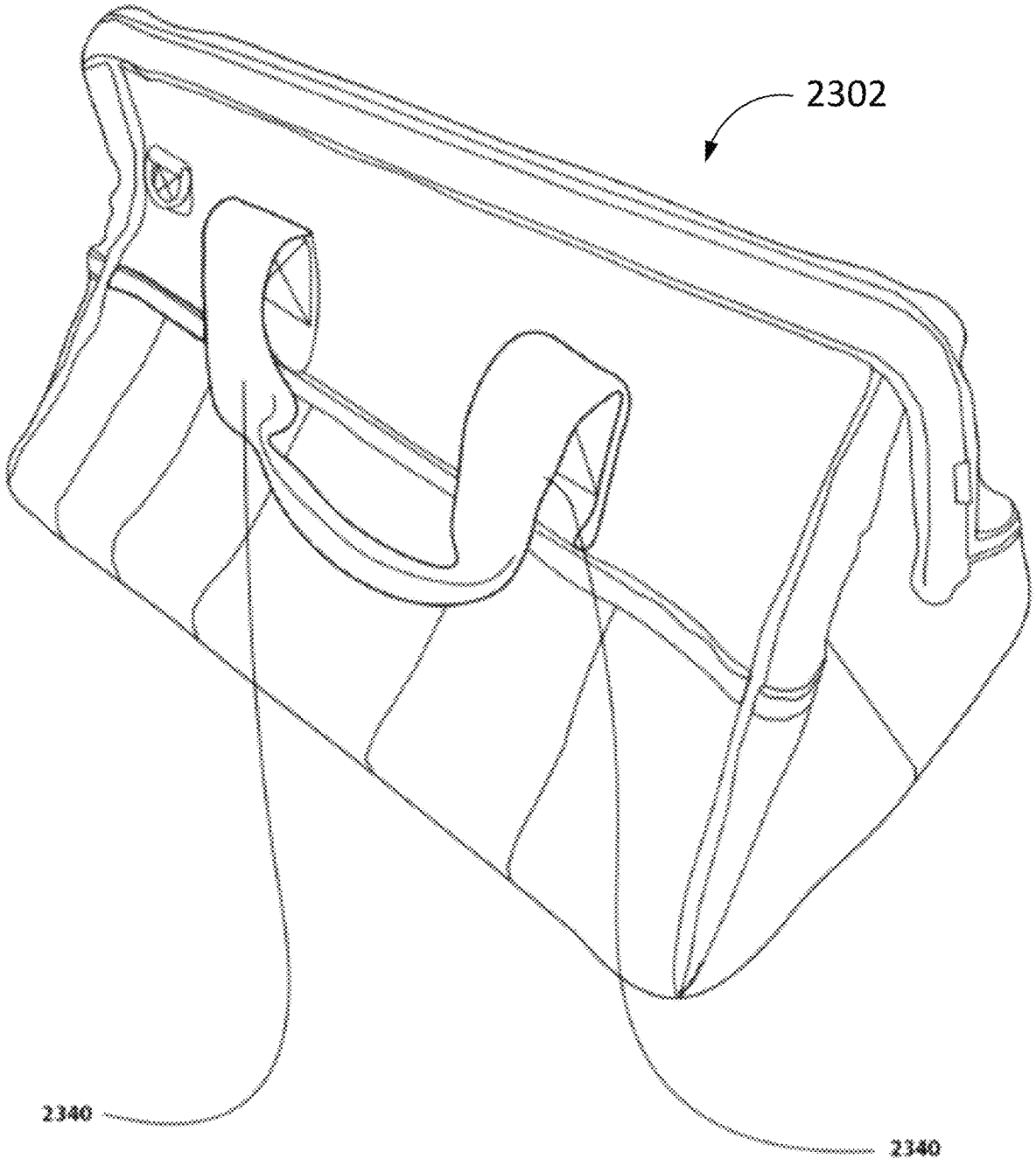
FIG. 28 shows a view of the pouch assembly of FIG. 23 lying on a side.
Figure 29:
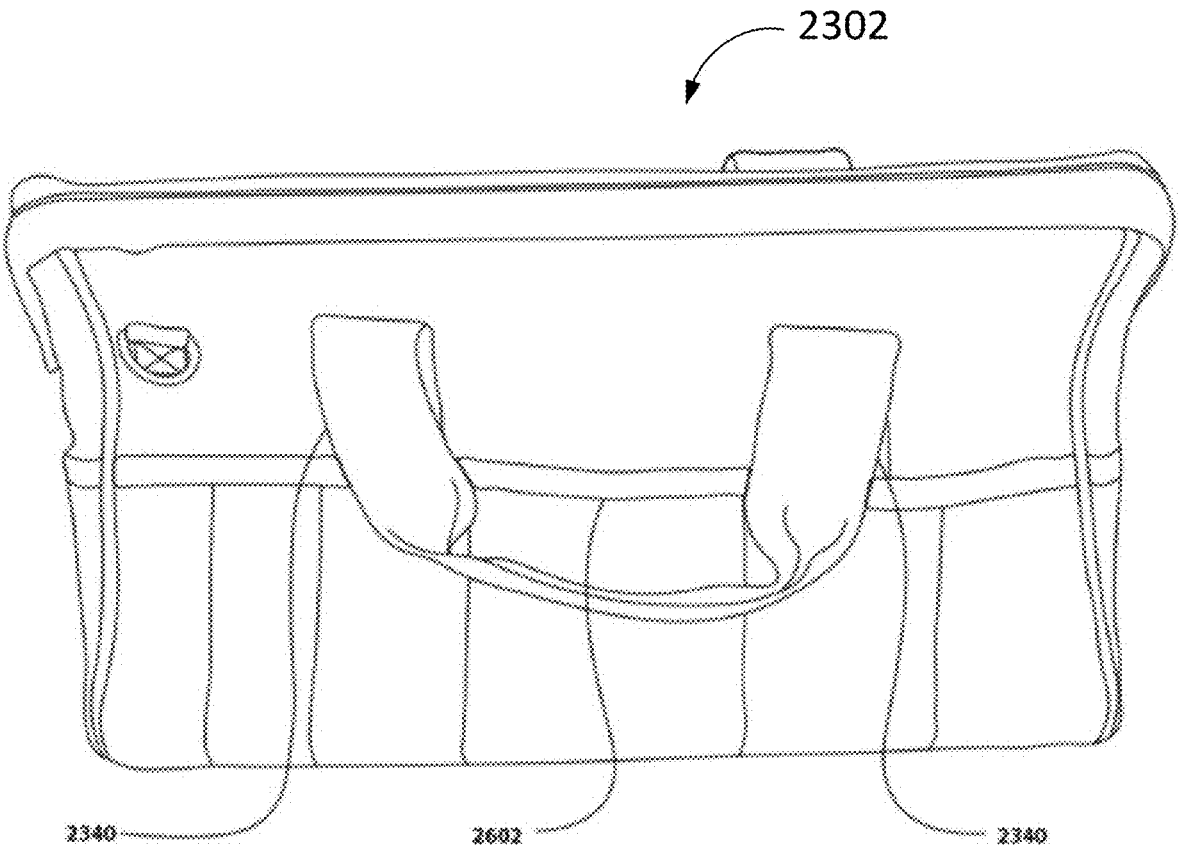
FIG. 29 shows a side view of the pouch assembly of FIG. 23.

FIGS. 26-29 show various views of a pouch assembly 2302. FIGS. 26 and 27 show a pouch assembly 2302 with the closure assembly in the open position, with FIG. 26 being a top side view (i.e., generally viewing along the long sides of the pouch assembly) and FIG. 27 showing a top front view. Handles 2340 facilitate carrying the pouch assembly. Multiple exterior pouches 2602 provide places for carrying objects, such as tools and supplies. D-Rings (not shown) can be attached to the pouch by a sew patch, to accommodate mounting of an optional strap (not shown). FIG. 28 is a view of pouch assembly 2302 lying on a side and FIG. 29 is a side view of pouch assembly 2302.

Figure 30:
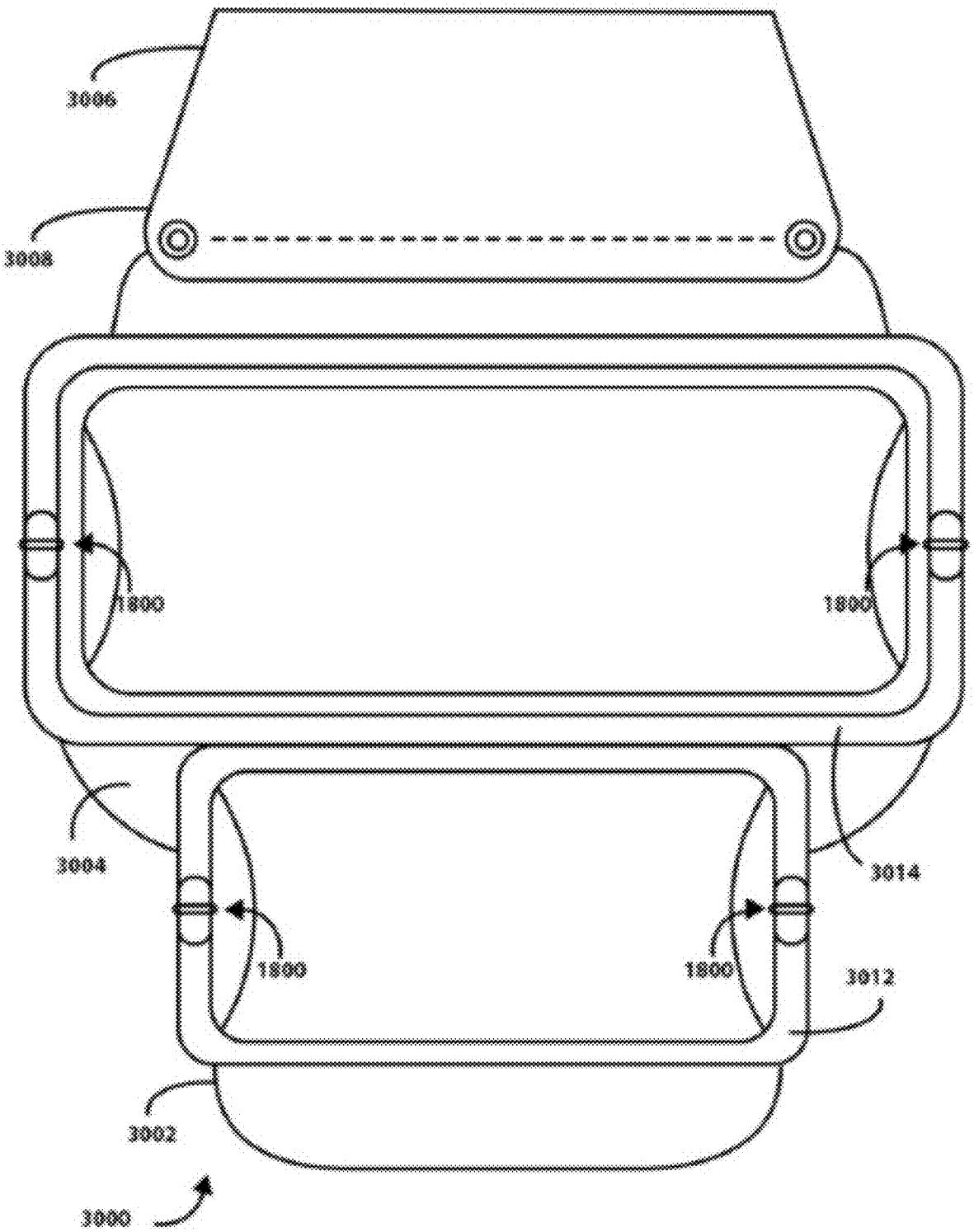
FIG. 30 shows a two-pouch assembly with both pouches held in fully open positions.

FIG. 30 shows a two-pouch assembly 3000, wherein both a small pouch 3002 and a large pouch 3004 are held in fully open positions with various embodiments of pouch closure 1800. In small pouch 3002, a smaller pouch closure 1800 is configured inside a pouch closure sleeve 3012, which may comprise the same material from which small pouch 3002 is fabricated or another material. Similarly, in large pouch 3004, a larger pouch closure 1800 is configured inside a pouch closure sleeve 3014 which also may comprise the same material from which large pouch 3004 is fabricated or another material. The sleeve may be formed by folding over the material forming the pouch and sewing it together. The pouch can be assembled by inserting the closure elements 1804 and 1812 into the sleeve on opposite sides of the pouch and then connecting closure elements 1804 and 1812 by attaching bi-stable hinges 1830 and 1832 (see FIG. 24).

In another embodiment, the sleeve may be formed by folding a portion of the flexible material from the pouch and attaching the folded portion to the other portion using hook-and-eye fasteners, such as Velcro® brand fasteners. This embodiment allows the pouch closure 1800 to be assembled before it is installed.

The sleeve preferably has an opening at the hinges to prevent the sleeve from interfering with the hinge operation. The sleeve may have additional opening(s) to facilitate attaching the pouch to the belt or to additional tool pouches.

Figure 31:
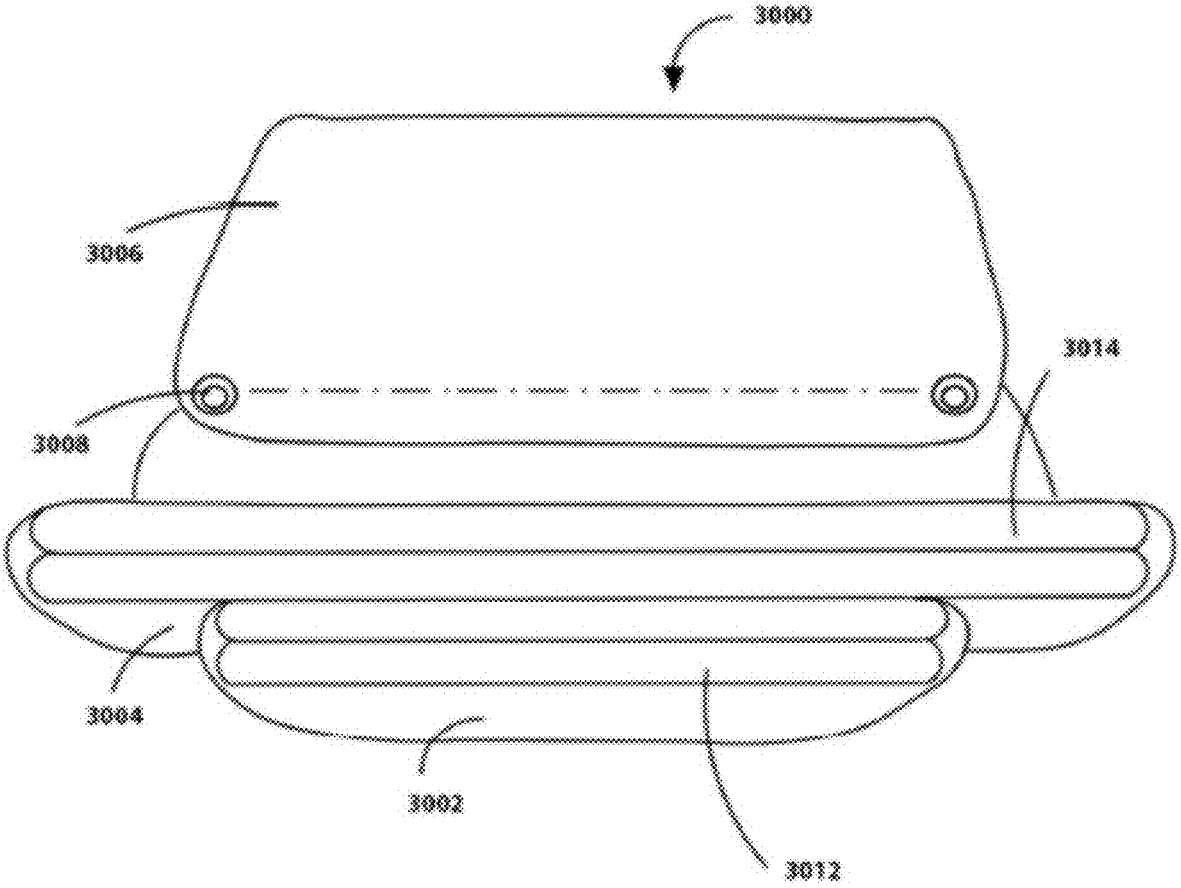
FIG. 31 shows the two-pouch assembly of FIG. 30 with both pouches held in closed positions.

Although two tool pouches are illustrated in FIGS. 30-31, embodiments may alternatively have one, or three or more tool pouches. The tool pouches in embodiments may be differing sizes, and/or one or more may be the same size. Pouch closures 1800 inside sleeves 3012 and 3014 may be sewn into place, and/or sleeves 3012 and 3014 may comprise tubular enclosures in which pouch closures 1800 are contained. In embodiments, each pouch closure 1800 may be removable for replacement, repair or maintenance in the event of damage to pouch closure 1800. Sleeve 3012 and/or sleeve 3014 may comprise gaps to facilitate removal or insertion of components of pouch closure 1800.

Tool pouch assembly 3000 may be self-supporting, carried by handles, or supported and connected to a belt (not shown) by a pouch loop 3006, attached to tool pouch 3000 by attachments 3008, which may be rivets, buttons, or other type of either permanent or detachable connections, which must be highly resistant to inadvertent detachment during use of tool pouch 3000 for safety reasons. Methods of attaching the tool pouch 3000 to the belt and to other tool pouches are described in U.S. Pat. Pub. 2017/0095069 and U.S. Pat. No. 9,427,067, both of which are hereby incorporated by reference.

FIG. 31 shows the two-pouch tool pouch 3000 of FIG. 30, wherein both small pouch 3002 and large pouch 3004 are held in fully closed positions with embodiments of pouch closure 1800.

Third Embodiment

Third Embodiment of a Pouch Closure

Figure 32:
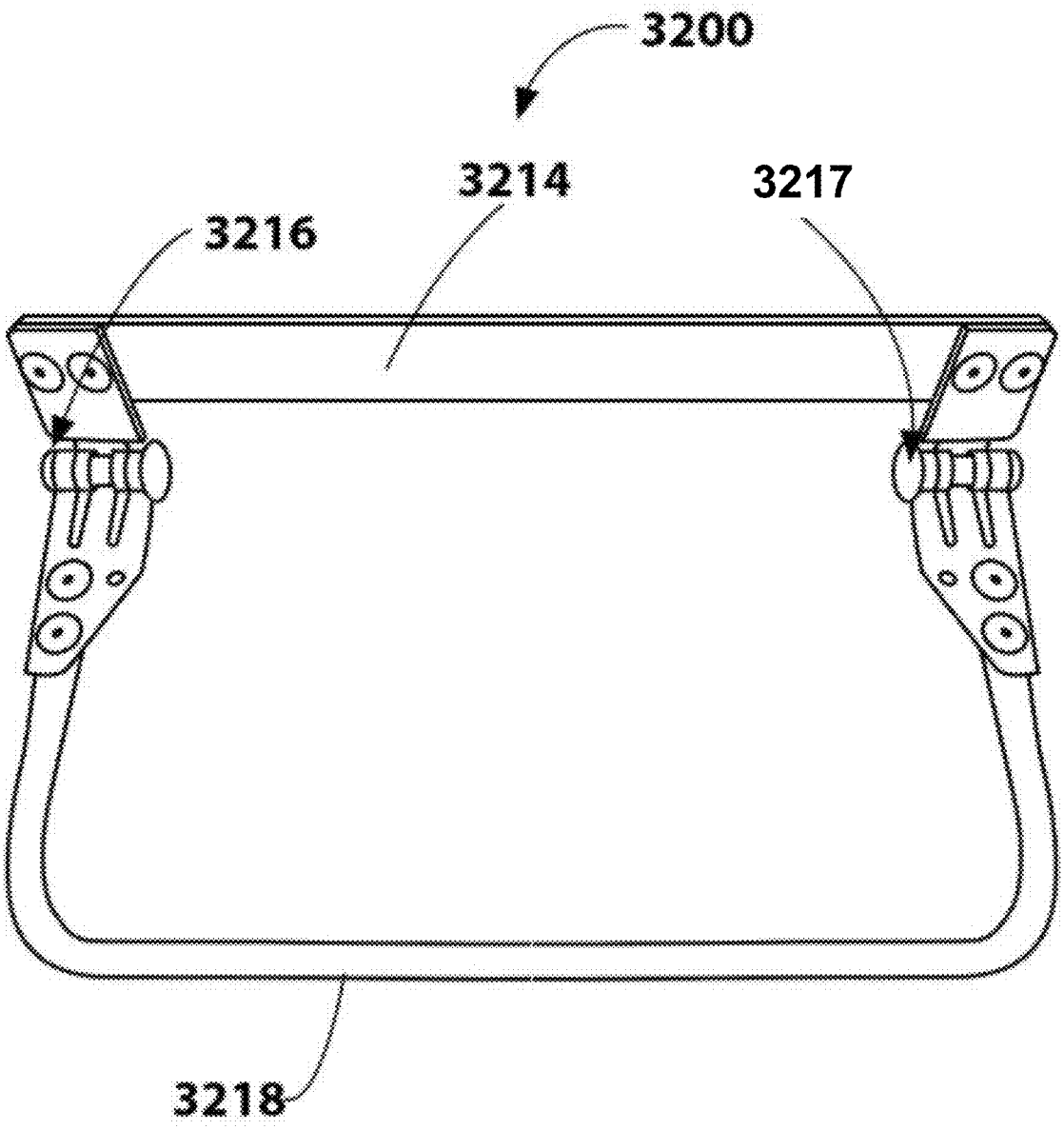
FIG. 32 shows an isometric view of a third embodiment of a pouch closure in an open position.
Figure 33:
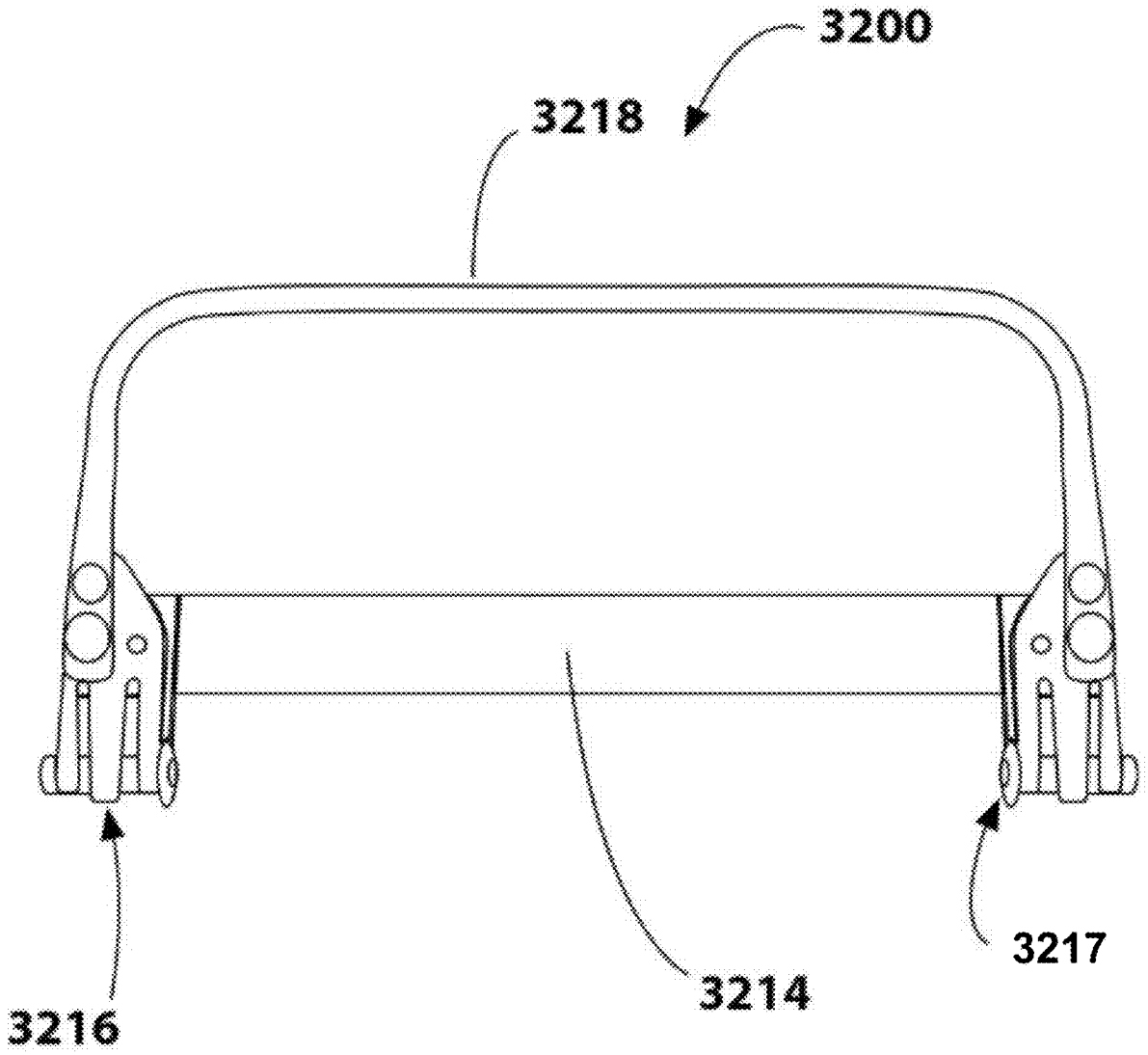
FIG. 33 shows an isometric view of the pouch closure of FIG. 32 in a closed position.
Figure 34:
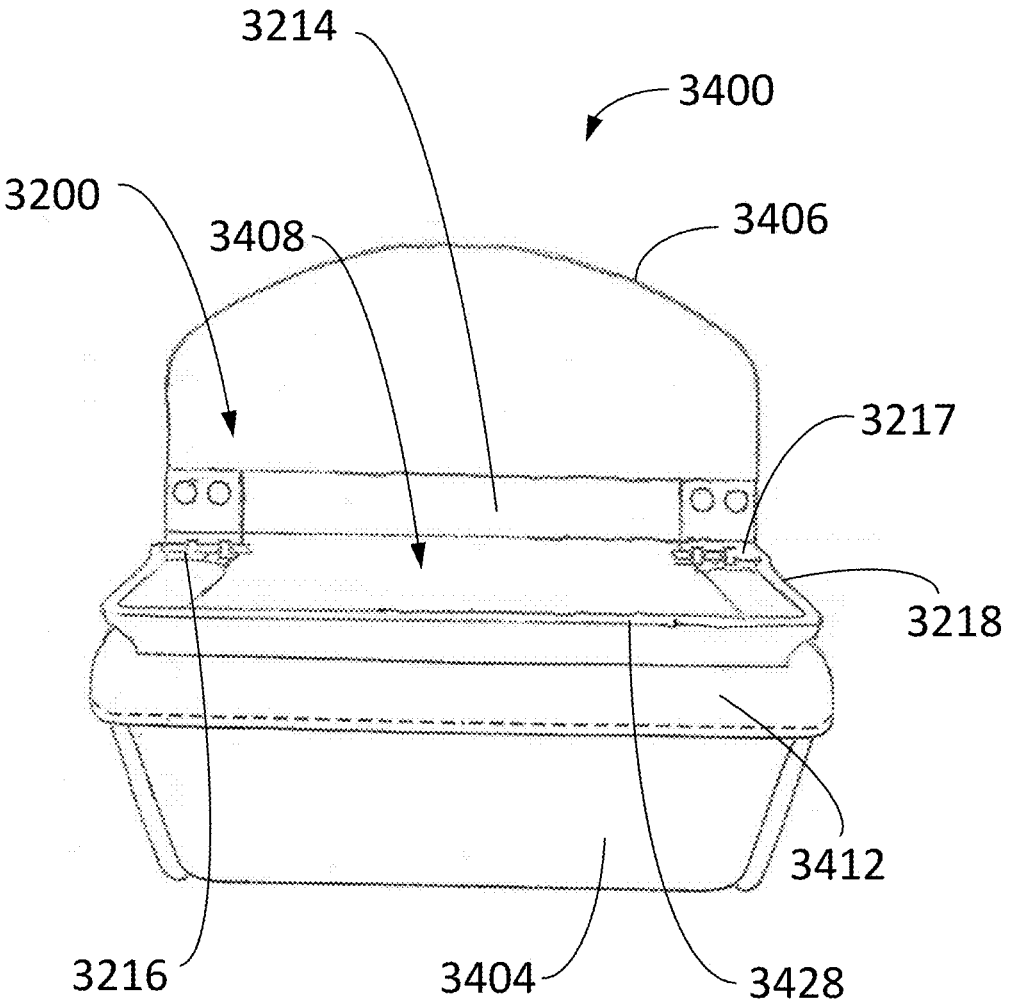
FIG. 34 shows a third embodiment of a pouch assembly in an open position.
Figure 35:
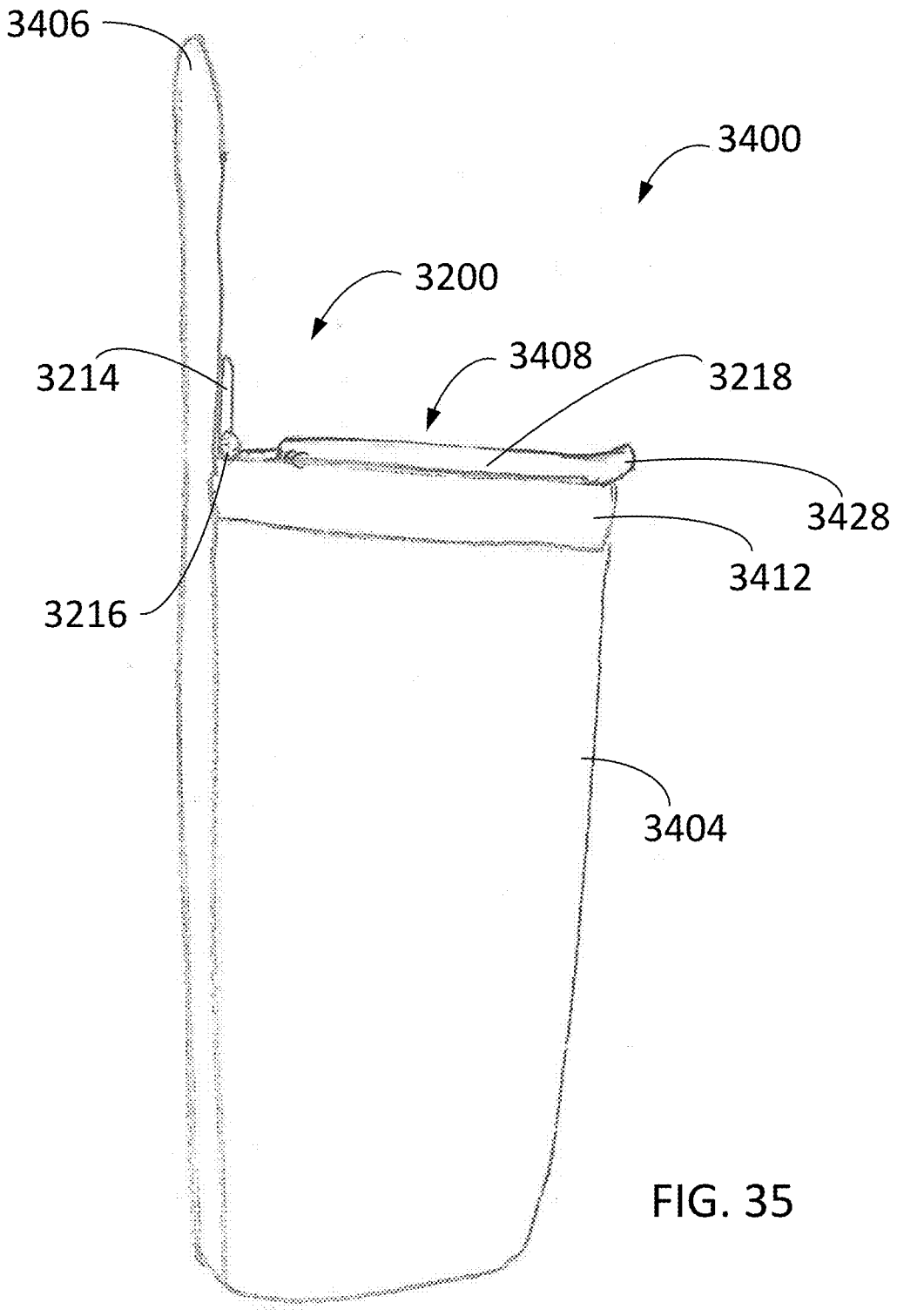
FIG. 35 shows a side view of the pouch assembly of FIG. 34 in an open position.

FIG. 32 shows an isometric view of a third embodiment of a spring-hinged closure 3200 in an open position—this position corresponds to the pouch assembly 3400 in FIG. 34. The spring-hinged closure 3200 illustrated in FIGS. 32-33 comprises two hinges 3216 and 3217 which function similarly to the hinges 1830 and 1832 in FIG. 18, and a first side 3214 and a second side 3218. In some embodiments, both hinges 3216 and 3217 may be bi-stable. In some embodiments, only one of the hinges 3216 and 3217 may be bi-stable. Hinges 3216 and 3217 may be of the same design, or similar to the design of, the over-center cam-spring hinges 210 of FIG. 5.

In some embodiments, the design aspects of spring-hinged closure 3200 may be determined by the requirements of a pouch assembly 3400 (FIGS. 34-37) into which the spring-hinged closure 3200 is to be installed. The second side 3218 may be of varying aspect ratios and shapes (rectangular, square, round, oval, etc.). In some embodiments, the second side 3218 may comprise a plurality of rigid straight sections. In some embodiments, some of these rigid straight sections may be connected by rigid straight and/or curved sections. In some embodiments, the second side 3218 may have a circular, oval, or elliptical shape. In some embodiments, the second side 3218 may comprise one or more flat bands, wherein the one or more flat bands may be connected together by rivets, screws, or other types of fasteners. In some embodiments, the materials used to fabricate the second side 3218 may comprise a rod, that is, a rigid wire-like structure. The rod may be solid or have a rigid hollow tubular form. The cross-sectional shapes of the solid wire-like or rigid hollow tubular material may be rectangular, square, round, oval, hexagonal, etc. In the embodiment of FIGS. 32-33, the second side 3218 is not required to bend, and so can be thick and rigid. The second side 3218 may typically have a thickness of greater than $1/8^{th}$ of an inch and preferably greater than 3/16 of an inch. Some embodiments may use a solid rod having a circular cross-section with a diameter of between 1/8 inch and 1/2 inch. In some embodiments, the second side 3218 may be fabricated from metal or other strong and durable materials. In some embodiments, the second side 3218 may comprise rigid solid wires or rigid hollow tubing, and the ends of the second side 3218 which attach to hinges 3216 and 3217 may have a different cross-sectional shape than the center portions of the second side 3218 to facilitate a stronger or easier attachment of hinges 3216 and 3217. In some embodiments, the second side 3218 may comprise a rod having a center section and two side sections, where the two side sections are angled with respect to the center sections. In some embodiments, the second side 3218 may be a bent rod where the directions of the axes of the two ends of the bent rod differ from the direction of axis of the center of the rod.

The first side 3214 of spring-hinged closure 3200 may be of varying aspect ratios and shapes (rectangular, square, round, oval, etc.). In some embodiments, the first side 3214 may be fabricated from metal or other strong and durable materials. In some embodiments, the cross-sectional shape of first side 3214 may be rectangular, square, round, oval, etc., wherein a range of cross-sectional shapes fall within the scope of the invention. In the embodiment of FIGS. 32-33, the first side 3214 is not required to bend, and so can be thick and stiff.

Figure 37:
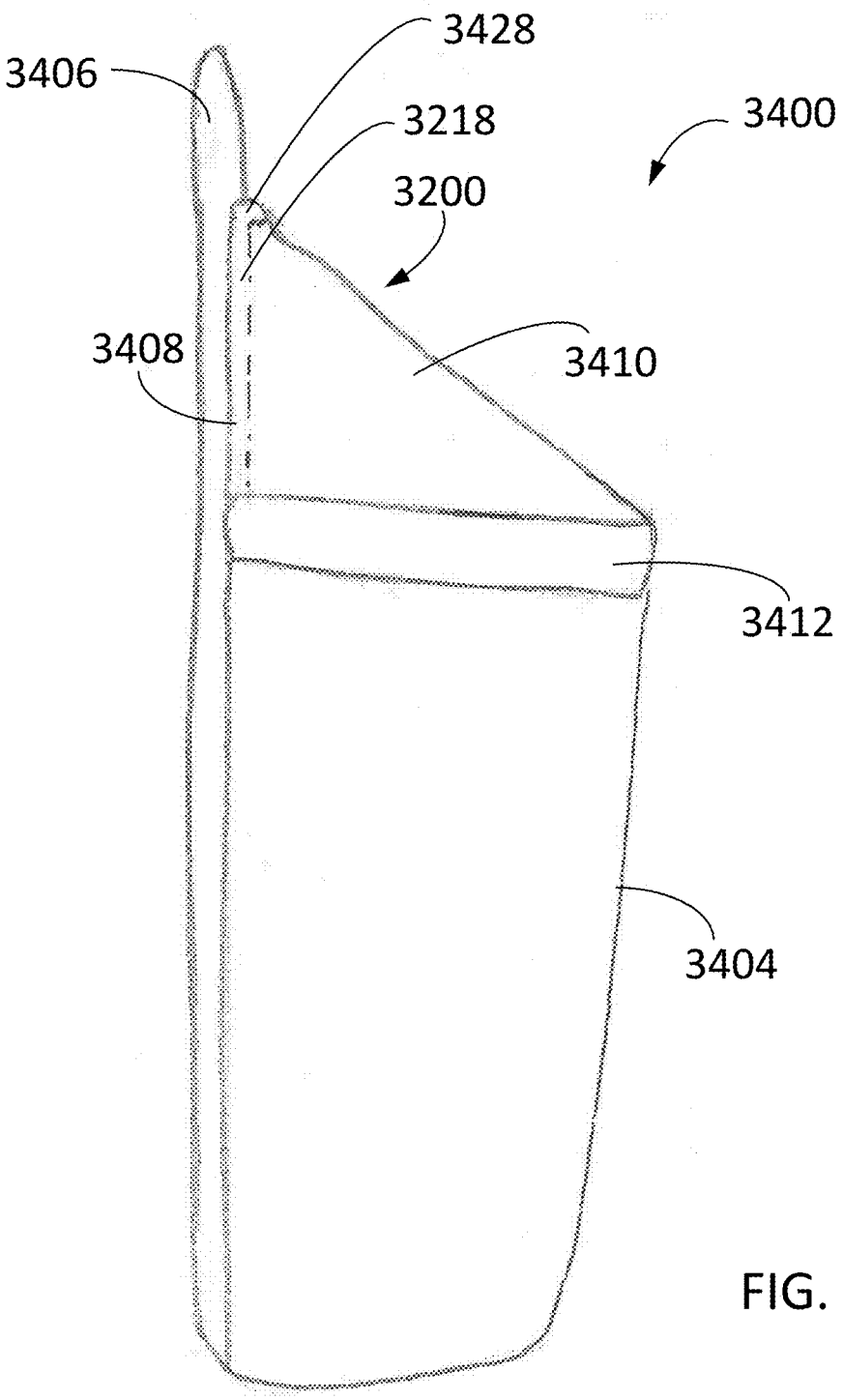
FIG. 37 shows a side view of the pouch assembly of FIG. 34 in a closed position.

FIG. 33 shows an isometric view of the third embodiment of the pouch closure of FIG. 32 in a closed position—this position corresponds to the pouch assembly in FIG. 37.

Third Embodiment of a Pouch Assembly

FIG. 34-37 show a third embodiment of a pouch assembly 3400 comprising a pocket 3404 which may be fixedly-attached to a side of a back 3406 and a spring-hinged closure 3200 as described in FIGS. 32-33. The back 3406 is preferably rigid or semirigid. The pocket 3404 may be rigid or semi-rigid and may have an opening at the top through which tools, instruments, etc., may be inserted into the pouch assembly 3400 and/or removed from the pouch assembly 3400. The first side 3214 of spring-hinged closure 3200 may be fixedly-attached to the back 3406. A cover 3410 (FIG. 36) may have first and second edges, wherein the second edge may be fixedly-attached to the pocket 3404 and wherein the first edge may comprise a sleeve 3428. The sleeve 3428 may cover the second side 3218 of spring-hinged closure 3200 to form an attachment between the second side 3218 and the first edge of cover 3410. In some embodiments, the sleeve 3428 at the first edge of the flexible cover may be formed by folding over the first edge of the flexible cover and sewing it together. In some embodiments, the sleeve 3428 may comprise a strip of cloth sewn together along its long axis to make a tube, wherein the tube is then sewn to the first edge of the flexible cover. In some embodiments, the second side 3218 of spring-hinged closure 3200 may be removed from the sleeve 3428 without removing the stitches. In some embodiments, the sleeve 3428 substantially surrounds the second side 3218 except for a region of spring-hinged closure 3200 around hinges 3216 and 3217. Arrow 3430 indicates a pivoting motion of the second side 3218 of pouch closure 3200 between the open position in FIG. 35 and the closed position in FIG. 37.

Figure 36:
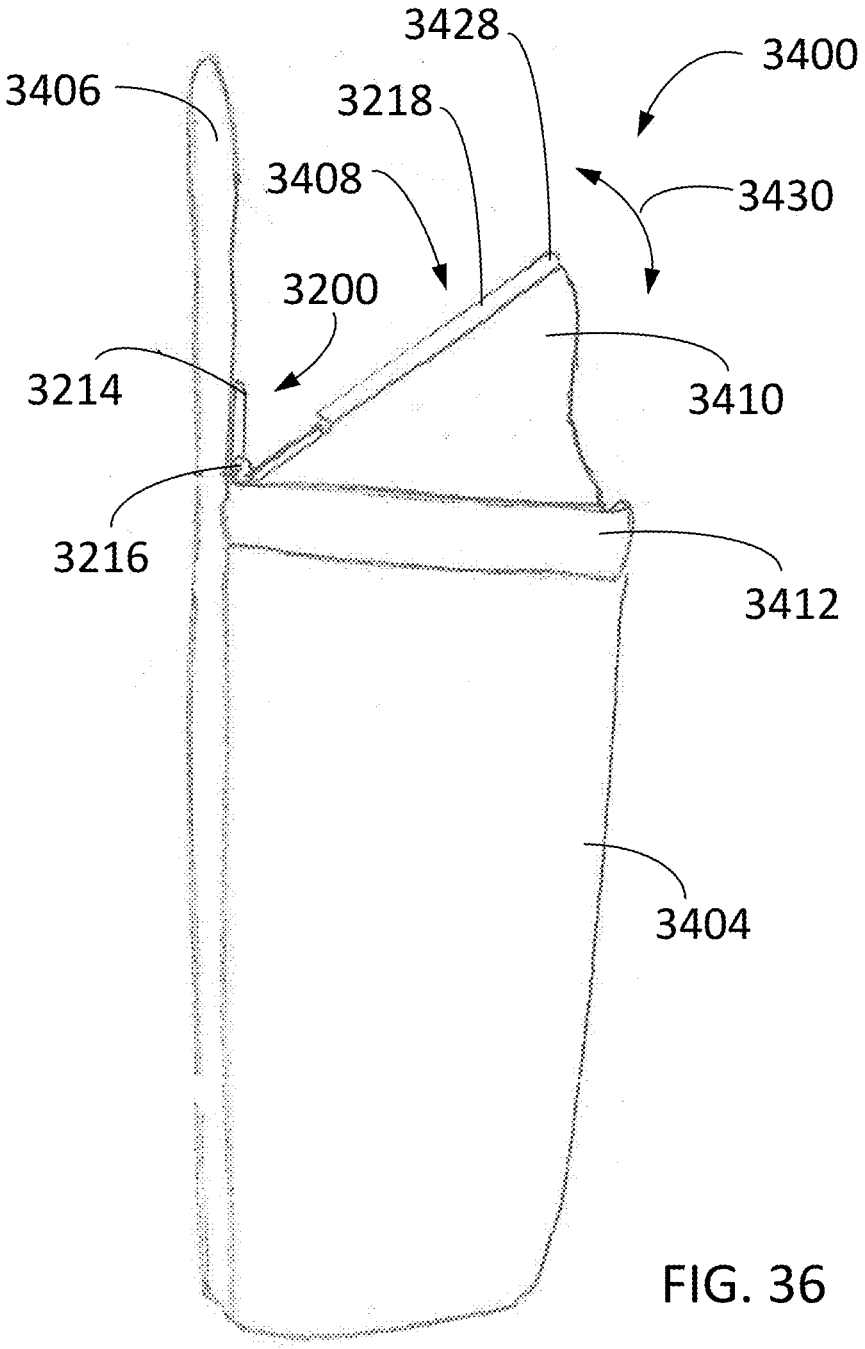
FIG. 36 shows a side view of the pouch assembly of FIG. 34 in a partially open position.

Pouch assembly 3400 has two stable positions: open (FIGS. 32 and 35, where spring-hinged closure 3200 or another mechanism exerts a force to maintain pouch assembly 3400 open) and closed (FIGS. 33 and 37, where spring-hinged closure 3200 exerts a force to maintain pouch assembly 3400 closed). FIG. 36 shows pouch assembly 3400 in a partially-open (partially-closed) position in which spring-hinged closure 3200 exerts at most a minimal force in either a closing or an opening direction. An upper pouch edge 3412 may surround the top opening of pocket 3404. The second side 3218 of spring-hinged closure 3200 moves between the open position in FIG. 35 (wherein the cover 3410 may be pressed down against upper pouch edge 3412) and the closed position in FIG. 37 (wherein the second side 3218 of spring-hinged closure 3200 may be pressed against the back 3406, thereby pulling cover 3410 across the top of the opening in pocket 3404 to prevent the contents of pouch assembly 3400 from falling out). The second side 3218 of spring-hinged closure 3200 connecting between hinges 3216 and 3217 may form an attachment structure for one edge of a flexible cover 3410. Another edge of cover 3410 may be attached to pouch edge 3412. When pouch assembly 3400 is closed (FIG. 37), cover material 3410 serves to prevent any contents within pouch assembly 3400 from falling out. When pouch assembly 3400 is fully open (FIG. 35), cover material 3410 may be folded and compressed between second side 3218 and pouch edge 3412 by the motion of second side 3218 to facilitate insertion and removal of the contents of pouch assembly 3400 during use.

Hinges 3216 and 3217 are shown in FIG. 32 holding spring-hinged closure 3200 in an open position without the need for the user to perform any manual locking operation to maintain the open position. In the illustration, the opening angle between sides 3214 and 3218 is approximately 90°, however other opening angles as determined by the design of bi-stable hinge 1830 could be used. Hinges 3216 and 3217 may work in tandem to hold the spring-hinged closure 3200 in either an open or a closed position. Hinges 3216 and 3217 have rotation axes, which in some embodiments are generally co-linear.

In some embodiments, the sides of pouch 3404 are rigid or semirigid, while the front and bottom portion may be more flexible. The upper pouch edge 3412 may include a facing or other material to form a rim that is thicker and/or more rigid than the rest of the front of pouch 3404 to provide a firm seat for second side 3218 when the cover 3410 is in the open position and to keep the top of pocket 3404 sufficient open to allow putting tools into the pocket and taking tools out of the pocket. The cover 3410 may be composed of flexible material that fold into the inside of pocket 3404. Cover 3410 may also fold like an accordion and cover 3410 in an accordion fold embodiment could be rigid with joints between panels.

There are many ways pocket 3404 can be formed, and the invention is not limited to any particular design or method of forming pocket 3404. Back 3406 may be used as the back of the enclosure of pocket 3404, or a separate material may be used to for the back part of the enclosure. The bottom and front of pocket 3404 may be formed by fabric that is attached to a lower portion of back 3406 and that extends out and up to upper pouch edge 3412, supported and shaped by rigid sides. In some embodiments, the back 3406 may form part of a tool bag or tool tote (FIGS. 38-39).

Figure 38:
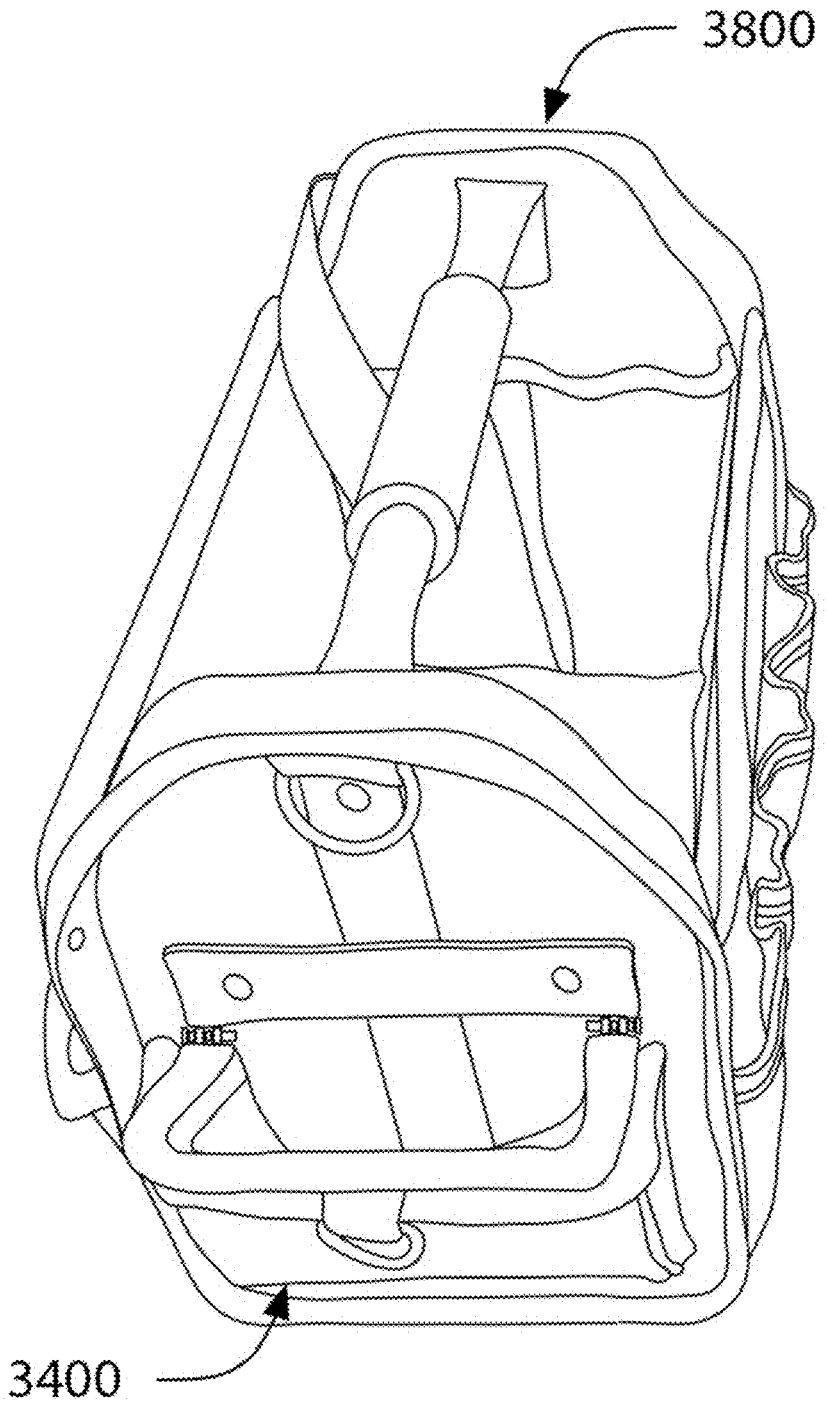
FIG. 38 shows a view of the pouch assembly of FIG. 34 with some pockets open.
Figure 39:
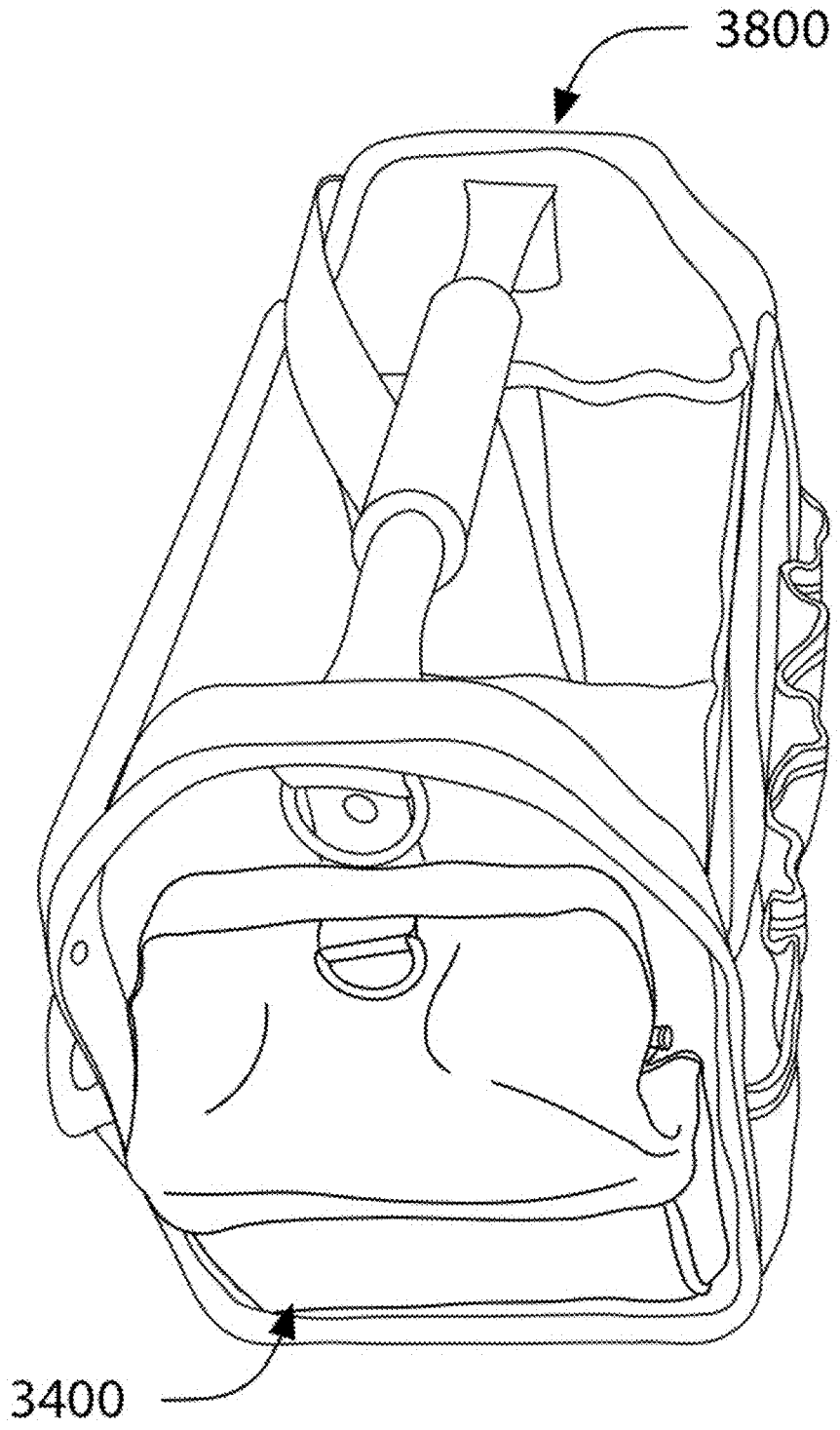
FIG. 39 shows a view of the pouch assembly of FIG. 34 with all pockets closed.

In some embodiments, pouch assembly 3400 may be combined with another pouch assembly 3802 into a single system 3800 as illustrated in FIGS. 38 and 39. A portion of the pouch assembly 3000 can form the back 3406 of pouch assembly 3400. In some embodiments, a belt (typically worn by a user) may support the tool pouch assembly. In some embodiments, the pouch assembly 3800 may be carried using a handle. FIG. 38 shows pouch assemblies 3000 and 3400 with some pockets open, while FIG. 39 shows pouch assemblies 3000 and 3400 with all pockets closed.

Additional Pouch Closure Embodiments

Additional pouch closure embodiments fall within the scope of the invention.

In pouch closure 1800, hinge 1830 may be a uni-stable hinge comprising a cam-spring mechanism having a stable closed position. In pouch closure 1800, hinge 1832 may be a uni-stable hinge comprising a cam-spring mechanism having a stable open position. When pouch closure 1800 in an open position (FIG. 18), hinge 1832 will then act to hold pouch closure 1800 open while hinge 1830 will not exert an appreciable closing force. When pouch closure 1800 is in a closed position (FIG. 19), hinge 1830 will then act to hold pouch closure 1800 closed while hinge 1832 will not exert an appreciable opening force.

In pouch closure 3200, hinge 3216 may be a uni-stable hinge comprising a cam-spring mechanism having a stable closed position. In pouch closure 3200, hinge 3217 may be a uni-stable hinge comprising a cam-spring mechanism having a stable open position. When pouch closure 3200 is in an open position (FIG. 32), hinge 3217 will act to hold pouch closure 3200 open while hinge 3216 will not exert an appreciable closing force. When pouch closure 3200 is in a closed position (FIG. 33), then hinge 3216 will act to hold pouch closure 3200 closed while hinge 3217 will not exert an appreciable opening force.

In some embodiments, hinges in the pouch closure embodiments 100, 1800, and 3200, may comprise a flexible material. When a hinge is moved to a closed position, the flexible material may be bent into a first configuration while when the hinge is moved to an open position, the flexible material may be bend into a second configuration.

In some embodiments, the flexible material may have a single preferred configuration, corresponding to either an open or a closed position of the hinge, thereby effecting uni-stable operation of the hinge. The flexible material may comprise features such as bends, folds, crimped structures, etc. to effect uni-stable operation of the hinge. The flexible material may have a preferential degree of bending to effect uni-stable operation of the hinge.

In some embodiments, the flexible material may have two preferred configurations, corresponding to both open and closed positions of the hinge, thereby effecting bi-stable operation of the hinge. To enable the flexible material to have two preferred configurations, the flexible material may comprise features such as bends, folds, crimped structures, etc., as well as a preferential degree of bending of the flexible material itself.

Although the present invention and its advantages have been described in detail, it should be understood that various changes, substitutions and alterations can be made to the embodiments described herein without departing from the scope of the invention as defined by the appended claims. Moreover, the scope of the present application is not intended to be limited to the particular embodiments of the process, machine, manufacture, composition of matter, means, methods and steps described in the specification.

As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claims as follows:

1. A tool pouch assembly, comprising:

a flexible tool pouch having first and second opposing sides;

a spring hinged closure formed from a rod or a band, the spring hinged closure including a first side and a second side, wherein the first side of the spring hinged closure and the second side of the spring hinged closure are movable relative to each other between a first stable position and a second stable position, and wherein the first side of the spring hinged closure and the second side of the spring hinged closure are configured to close the top portion of the tool pouch when in the first stable position and to open a top portion of the tool pouch when in the second stable position;

a protective sleeve in the form of a tube formed by a fabric separate from the tool pouch fabric and sewn together along its long axis, the protective sleeve substantially surrounding the spring hinged closure, the protective sleeve with the spring hinged closure being attached inside the tool pouch;

the first side of the spring hinged closure together with the surrounding protective sleeve being attached to the first side of the tool pouch and the second side of the spring hinged closure together with the surrounding protective sleeve being attached to the second side of the tool pouch.

2. A tool pouch assembly for carrying items, comprising:

a pouch composed of a flexible material, the pouch having two long sides and two short sides;

a closure attached to the pouch and configurable into a first configuration in which the flexible material is spread to create an opening at a top of the pouch for inserting items into, and removing items from, the pouch, and into a second configuration in which the flexible material is gathered to close the opening at the top of the pouch to keep items within the pouch, the closure including:

a first closure element, having a first end and a second end;

a second closure element, having a first end and a second end;

a first hinge pivotally connecting the first end of the first closure element and the first end of the second closure element; and a second hinge, pivotally connecting the second end of the first closure element and the second end of the second closure element; and a sleeve formed from a material that is attached to the pouch, the closure being positioned within the sleeve;

the closure configured such that in a first stable position, the flexible material is gathered at the top to close the pouch, and in a second stable position, the flexible material is spread apart to open the pouch, in which the sleeve material is sewn together along its long axis to make a tube, the tube having a top and a bottom, and in which the tube is sewn to the interior of pouch along the long sides and in which only the top of the tube is attached to the pouch along the short sides, thereby allowing the first and second closure elements to rotate more freely than if the bottom of the tube were sewn to the pouch along the short sides.

3. The tool pouch assembly of claim 2, in which the sleeve supports the closure and attaches it to the pouch.

4. The tool pouch assembly of claim 2, in which the sleeve substantially surrounds the closure except for a region of the closure around each hinge.

5. The tool pouch assembly of claim 2, in which the tube includes gaps, with the hinges extending from the gaps in the tube.

6. The tool pouch assembly of claim 2, in which the tube includes slits, with the hinges extending from the slits in the tube.

7. A tool pouch assembly for carrying items, comprising:

a pouch composed of a flexible material, the pouch having a long axis and a short axis;

a closure attached to the pouch and configurable into a first configuration in which the flexible material is spread to create an opening at a top of the pouch for inserting items into, and removing items from, the pouch, and into a second configuration in which the flexible material is gathered to close the opening at the top of the pouch to keep items within the pouch, the closure including:

a first closure element, having a first end and a second end;

a second closure element, having a first end and a second end;

a first hinge pivotally connecting the first end of the first closure element and the first end of the second closure element; and a second hinge, pivotally connecting the second end of the first closure element and the second end of the second closure element; and a sleeve formed from a material that is not part of the pouch, the closure being positioned within the sleeve and the sleeve attached to the pouch;

the closure configured such that in a first stable position, the flexible material is gathered at the top to close the pouch, and in a second stable position, the flexible material is spread apart to open the pouch, in which the sleeve comprises a strip of cloth sewn together along its long axis to make a tube, the tube having a top and a bottom, and in which the top of the tube and the bottom of the tube are sewn to the pouch along the long axis and in which only the top of the tube is sewn to the pouch along the short axis, thereby allowing the first and second closure elements to rotate more freely than if the bottom of the tube were sewn to the pouch along the short axis.

8. The tool pouch assembly of claim 2, in which at least one of the hinges is a bi-stable hinge that maintains the closure in the first configuration or in the second configuration.

9. The tool pouch assembly of claim 2, wherein the bi-stable hinge comprises an over-center cam-spring mechanism, and wherein the bi-stable hinge has a stable closed position and a stable open position.

10. The tool pouch assembly of claim 2, in which the closure is configured such that moving the first and second hinges in a first direction toward a bottom of the pouch gathers the flexible material at the top to close the pouch, and moving the first and second hinges in a second direction opposite to the first direction separates the flexible material to open the pouch.

11. The tool pouch assembly of claim 2, in which the first closure element and the second closure element each comprise a rod having a center section and two side sections, the two sides sections being angled with respect to the center section, the first and second ends of each of the closure elements terminating the side sections.

12. The tool pouch assembly of claim 2, in which the first closure element and the second closure elements are bent rods, such that for each rod, the directions of axes of the first and second ends are different from the direction of an axis of the center of the rod.

13. The tool pouch assembly of claim 2, in which the first hinge has a first hinge rotation axis and the second hinge has a second rotation axis, and in which the first rotation axis and the second rotation axis are substantially co-linear.

14. The tool pouch assembly of claim 2, wherein the sleeve is sewn to the pouch using stitches and in which the first and second closure elements can be removed from the sleeves without removing the stitches.

15. The tool pouch assembly of claim 2, further comprising handles attached to the pouch for carrying the tool pouch assembly.

16. The tool pouch assembly of claim 2, further comprising a pouch loop, configured to attach the tool pouch assembly to a belt.

17. The tool pouch assembly of claim 2, wherein the first and second closure elements have rectangular, square, oval or elliptical cross-sectional shapes.

18. The tool pouch assembly of claim 2, wherein the first and second closure elements comprise rigid solid wire-like or rigid hollow tubular material.

19. The tool pouch assembly of claim 2, wherein, in the first and second closure elements, the first and second ends have cross-sectional shapes different from the cross section shapes away from their respective ends to facilitate attachment of the first and second closure elements to the hinges.

20. A system for carrying items, comprising:

a first tool pouch assembly in accordance with claim 2; and a belt supporting the pouch.

21. The system of claim 20, further comprising a connector for connecting a second pouch to the first pouch on a second side of the pouch opposite the first side.

22. The system of claim 20, comprising a multiplicity of tool pouch assemblies including the first tool pouch, each tool pouch being configured to be able to be opened or closed independently of the open or closed configurations of other tool pouches in the multiplicity of tool pouches in the tool pouch.

23. A tool pouch assembly, comprising:

a flexible tool pouch having first and second opposing sides;

a bi-stable hinge closure that includes a first side and a second side, wherein the first side of the bi-stable hinge closure and the second side of the bi-stable hinge closure are movable relative to each other between a first stable position and a second stable position, and wherein the first side of the bi-stable hinge closure and the second side of the bi-stable hinge closure are configured to close the top portion of the tool pouch when in the first stable position and to open a top portion of the tool pouch when in the second stable position;

a protective layer formed as a tube from a flexible material separate from the tool pouch sewn together along its long axis, the protective layer substantially surrounding the spring hinged closure, the protective layer substantially surrounding the bi-stable hinge closure and attached to the inside of the tool pouch along the long sides and along the short sides, in which only the top of the sleeve tube is sewn to the pouch along the short axis, thereby allowing the first and second closure elements to rotate more freely than if the bottom of the tube were sewn to the pouch along the short axis.

24. The tool pouch assembly of claim 1 in which the sleeve is attached to the pouch along the long sides and along the short sides.

25. The tool pouch assembly of claim 24 in which the sleeve is attached to the pouch along the entire length of the sleeve.

* * * * *